US005320937A

United States Patent [19]

Ihama

[11] Patent Number: 5,320,937

[45] Date of Patent: Jun. 14, 1994

[54] SILVER HALIDE PHOTOGRAPHIC EMULSION

[75] Inventor: Mikio Ihama, Minami-Ashigara, Japan

[73] Assignee: Fuji Photo Film Co., Ltd., Kanagawa, Japan

[21] Appl. No.: 989,461

[22] Filed: Dec. 10, 1992

Related U.S. Application Data

[63] Continuation of Ser. No. 608,838, Nov. 5, 1990, abandoned.

[30] Foreign Application Priority Data

Nov. 6, 1989 [JP] Japan ..... 1-287380

[51] Int. Cl.[5] ..... G03C 1/005

[52] U.S. Cl. ..... 430/567; 430/505; 430/569; 430/603; 430/605; 430/611

[58] Field of Search ..... 430/603, 605, 611, 567, 430/569, 505

[56] References Cited

U.S. PATENT DOCUMENTS

| | | | |
|---|---|---|---|
| 4,801,526 | 1/1989 | Yoshida et al. | 430/567 |
| 4,873,181 | 10/1989 | Miyasaka et al. | 430/611 |
| 4,897,342 | 1/1990 | Kajiwara et al. | 430/569 |
| 5,021,323 | 6/1991 | Yamamoto | 430/567 |

FOREIGN PATENT DOCUMENTS

| | | |
|---|---|---|
| 0232865 | 8/1987 | European Pat. Off. . |
| 0369424 | 5/1990 | European Pat. Off. . |
| 0410410 | 1/1991 | European Pat. Off. . |
| 1115038 | 5/1968 | United Kingdom . |

OTHER PUBLICATIONS

Journal of Photographic Science, vol. 24, 1976, "The Effects of Crystal Size . . . " to K. Radcliffe, pp. 190–202.

*Primary Examiner*—Thorl Chea

*Attorney, Agent, or Firm*—Birch, Stewart, Kolasch & Birch

[57] ABSTRACT

A silver halide photographic emulsion contains silver halide grains comprising at least two portions, i.e., a core and an outermost shell with different silver halide compositions and having an average aspect ratio of less than 8. The core consists of silver iodobromide, silver chloroiodobromide, silver chlorobromide, or silver bromide. An average silver iodide content of the outermost shell is higher than that of the core and is 6 mol % or more. The silver halide grains are subjected to all of selenium sensitization, gold sensitization, and sulfur sensitization.

20 Claims, No Drawings

SILVER HALIDE PHOTOGRAPHIC EMULSION

This application is a continuation of application Ser. No. 07/608,838 filed on Nov. 5, 1990, now abandoned.

BACKGROUND OF THE INVENTION

1. Field of the Invention

The present invention relates to a silver halide photographic emulsion.

2. Description of the Related Art

Conventionally, grains whose surface have high silver iodide content are known to be unpreferable as a negative photographic light sensitive material since development progress is significantly delayed. For example, J. Photo. Sci., 24, 198 (1976) describes a core/shell type grain whose shell has silver iodide content of 18 to 36 mol %. JP-A-62-19843 ("JP-A" means unexamined published Japanese patent application) describes a core/shell type color reversal photographic light-sensitive material in which the silver iodide content of a shell is higher than that of the core. This material is a reversal light-sensitive material aimed at increasing the sensitivity and contrast of pushing development by using a phenomenon in which development progress is delayed by grains having a high silver iodide content. Therefore, this color reversal photographic light-sensitive material is not suitable as a negative material. In addition, JP-A-49-90920 or JP-A-49-90921 describes grains in which a core consists of silver bromide, a shell consists of silver iodobromide, and a silver iodide content of the shell is 5, 10, or 15 mol %. However, these grains are used in a direct positive emulsion and therefore unsuitable as a negative emulsion. JP-A-56-78831 discloses a monodisperse grain whose surface has a silver iodide content of 6 to 8 mol %. However, these grains are effective only when they are used together with grains whose surface has a silver iodide content of 3 mol % or less, and only low sensitivity can be obtained by using only the former grains.

JP-A-60-147727 discloses, in its scope of claim, grains having a multilayered structure in which a difference between average silver iodide contents of two adjacent layers is 10 mol % or more and a silver iodide content of an outermost shell is 40 mol % or less, but it describes that a preferable silver iodide content of the outermost shell is 0 to 10 mol %. In addition, all of silver iodide contents of the outermost shells of grains described in the embodiments are 3 mol % or less.

JP-A-58-113927 discloses grains having a high silver iodide content in an outermost shell. However, these grains are tabular grains having an average aspect ratio of 8:1 or more.

JP-A-60-14331 discloses grains having a clear double structure but describes that the grains are silver halide fine crystals in which an outermost shell contains 5 mol % or less of silver iodide.

JP-A-61-245151 or JP A 62-131247 discloses grains having a multi-structure. In each reference, however, a silver iodide content of an outermost shell is lower than those of shells inside the outermost shell. In addition, no example in which the outermost shell has a silver iodide content of 6 mol % or more is described in the embodiments.

JP-B-44-15748 ("JP-B" means examined published Japanese patent application) discloses a photographic silver halide emulsion sensitized by at least two types of different sensitizers, i.e., a noble metal sensitizer and a nonlabile selenium sensitizer.

JP-B-43-13489 discloses a photographic silver halide emulsion sensitized by at least three types of different sensitizers, i.e., a noble metal sensitizer, a nonlabile selenium sensitizer, and a nonlabile sulfur compound.

SUMMARY OF THE INVENTION

It is an object of the present invention to provide sensitivity of silver halide grains having increased sensitivity in which an outermost shell has a higher silver iodide content than that of a core, the silver iodide content of the outermost shell is 6 mol % or more, and an aspect ratio is less than 8.

It is another object of the present invention to provide an emulsion which is subjected to selenium-sensitization and has low fog and good storage stability.

It is a further object of the invention to provide an emulsion having high sensitivity and superior graininess.

The above objects of the present invention can be achieved by the following means.

(1) A silver halide photographic emulsion containing silver halide grains comprising at least two portions, i.e., a core and an outermost shell with different silver halide compositions and having an average aspect ratio of less than 8, wherein the core comprises silver iodobromide, silver chloroiodobromide, silver chlorobromide, or silver bromide, an average silver iodide content of the outermost shell is higher than that of the core and is 6 mol % or more, and the silver halide grains are subjected to all of selenium sensitization, gold sensitization, and sulfur sensitization.

(2) A silver halide photographic emulsion described in item (1), wherein the grain further has at least one intermediate shell between the core and the outermost shell.

(3) A silver halide photographic emulsion described in item (1), wherein a projected area of the silver halide grains occupies at least 50% of the total projected area of all the grains contained in the emulsion.

(4) A silver halide photographic emulsion described in item (1), wherein the emulsion is of the negative type.

(5) A silver halide photographic emulsion described in item (4), wherein a sensitizing dye has been added during chemical ripening or before chemical ripening.

(6) A silver halide photographic emulsion described in item (5), wherein the emulsion contains a nitrogen-containing heterocyclic compound having a mercapto group.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

DETAILED DESCRIPTION OF THE INVENTION

The present invention will be described in detail below.

A silver halide grain contained in an emulsion of the present invention comprises at least a core and an outermost shell. In an isotropic silver halide grain, the core is a region belonging to the most central portion of the grain and does not form a surface, and the outermost shell is a region containing the surface of the grain, surrounds the core, and substantially forms the surface. The core and the outermost shell have different halide compositions, especially, different silver iodide contents. In an anisotropic silver halide grain, e.g., a tabular grain, a core and an outermost shell can be formed in regions away from each other in the direction parallel to the opposing major faces (111) of the grain. More specifically, the core can be formed by the grain portion which corresponds to the center of the major faces, while the outermost shell can be formed by the grain portion which corresponds to the periphery of the major faces. In this case, each of the core and the outermost shell has a surface. It should be noted that the core and the outermost shell can be formed in regions away from each other in the direction perpendicular to the opposing major faces (111) of the tabular grain. More specifically, the core can be formed by the grain portion which is center in the direction perpendicular to the major faces of the grain, while the outermost shell can be formed by those grain portions which sandwich the core portion of the grain. It should be also noted that the core and the outermost shell can be formed in regions away from each other in both the direction parallel to the major faces and the direction perpendicular to them. More specifically, the core can be formed by the grain portion which corresponds to the center of the major faces and which is center in the direction perpendicular to the major faces, while the outermost shell can be formed by those grain portions which surround the core portion of the grain.

The core comprises silver iodobromide, silver chloroiodobromide, silver chlorobromide, or silver bromide. The core preferably comprises silver iodobromide containing 0 to 12 mol % of silver iodide. More preferably, the core consists of silver iodobromide containing 6 mol % or less of silver iodide.

The outermost shell comprises silver chloroiodobromide or silver iodobromide, having a higher silver iodide content than that of the core. The silver iodide content of the outermost shell is preferably 6 to 40 mol %. More preferably, the silver iodide content is 8 to 30 mol %.

Most preferably, the silver halide grains contained in the emulsion of the present invention have at least one intermediate shell between the core and the outermost shell. This intermediate shell is a region of one or more layers of a silver halide, which is normally continuous but may take an island-sea structure. The intermediate shell preferably comprises silver chloroiodobromide, silver iodobromide, or silver bromide. The intermediate shell preferably comprises a halogen-converted silver halochloride layer, silver thiocyanate layer, or silver citrate layer described in JP A-1-102547. When the grain comprises a plurality of intermediate shells, a silver iodide content of each shell is preferably 0 to 40 mol %, more preferably, 30 mol % or less, and most preferably, 20 mol % or less.

In the present invention, if a silver iodide content is not uniform in the cores or in a shell, the silver iodide content of the core and the shell of the silver halide grain may take an average value.

The core, the intermediate shell, and the outermost shell may take arbitrary ratios in the whole grain. A ratio of the outermost shell is preferably 5% to 50%, and more preferably, 10% to 30% in molar fraction.

The core and the intermediate shell may take arbitrary ratios of 1:0.1 to 10 in molar ratio with respect to the outermost shell.

A silver iodide content of a grain as a whole can be adjusted by ratios of the core, the intermediate shell, and the outermost shell, and by the silver iodide content of each. The silver iodide content of a grain as a whole is 20 mol % or less, and preferably, 2.5 mol % or more.

In the emulsion of the present invention, it is preferable that silver iodide distributions within the grains are uniform among the grains. Whether the silver iodide contents are uniform between the grains can be checked by using an EPMA method (Electron-Probe Micro Analyzer method).

In this method, emulsion grains are dispersed well so as not to be in contact with each other to prepare a sample, and an electron beam is radiated on the sample, thereby performing element analysis for a very small portion by X-ray analysis caused by electron-ray excitation.

By this method, a halide composition of each grain can be determined by obtaining characteristic X-ray intensities of silver and silver iodide radiated from the grain.

When the silver iodide content distributions between the grains are measured by the EPMA method, a relative standard deviation is preferably 50% or less, more preferably, 35% or less, and most preferably, 20% or less.

Examples of a layer structure of the silver halide grain according to the present invention are listed in Table 1. The layer means the core, the intermediate shell(s), and the outermost shell. Symbols of the silver iodide content of each layer are defined as follows:

$I_i$; silver iodide content (mol %) of core $I_m^n$; silver iodide content (mol %) of intermediate shell (n is a natural number indicating the number of the interlayer from inside) and $I_o$; silver iodide content (mol %) of outermost shell.

TABLE 1

Preferable Layer Structure of Grain According To The Present Invention

| | | Example No. | | | | | | | | | | | |
|---|---|---|---|---|---|---|---|---|---|---|---|---|---|
| | | 1 | 2 | 3 | 4 | 5 | 6 | 7 | 8 | 9 | 10 | 11 | 12 |
| Silver Iodide Content (mol %) of Layer | $I_i$ | 0 (40)* | 0 (50) | 0 (10) | 0 (20) | 0 (60) | 3 (50) | 3 (50) | 3 (60) | 5 (10) | 5 (30) | 5 (60) | 0 (60) |
| | $I_m^1$ | 3 (40) | 3 (15) | 3 (50) | 10 (65) | 20 (20) | 9 (20) | 6 (15) | 10 (25) | 15 (60) | 0 (60) | 10 (20) | 20 (20) |
| | $I_m^2$ | — | 6 (15) | 6 (10) | — | — | — | 9 (15) | — | — | — | — | — |
| | $I_m^3$ | — | — | 9 (10) | — | — | — | — | — | — | — | — | — |
| | $I_o$ | 6 (30) | 10 (20) | 12 (20) | 20 (15) | 10 (20) | 6 (30) | 12 (20) | 20 (15) | 6 (30) | 12 (10) | 20 (20) | 40 (20) |
| | Average Silver Iodide | 2.7 | 3.35 | 5.4 | 9.5 | 6 | 5.1 | 6.15 | 7.3 | 11.3 | 2.7 | 9.0 | 12 |

TABLE 1-continued

| | Preferable Layer Structure of Grain According To The Present Invention | | | | | | | | | | | |
|---|---|---|---|---|---|---|---|---|---|---|---|---|
| | Example No. | | | | | | | | | | | |
| | 1 | 2 | 3 | 4 | 5 | 6 | 7 | 8 | 9 | 10 | 11 | 12 |
| Content Total Number of Layers | 3 | 4 | 5 | 3 | 3 | 3 | 4 | 3 | 3 | 3 | 3 | 3 |

*Numerals in parenthesis indicate a ratio (%) of silver in a whole grain.

The emulsion of the present invention has an average aspect ratio of less than 8. The emulsion may comprise grains having regular crystal form (regular grains) such as octahedral, dodecahedral, or tetradecahedral and an average aspect ratio of about 1 or may take irregular crystal forms such as spherical or potato-like forms. The grains are preferably tabular grains having an aspect ratio of less than 8, and more preferably, tabular grains having an aspect ratio of 3 to 8. The tabular grain is a general term representing grains having one twin plane or two or more parallel twin planes. When ions at all lattice points at two sides of a (111) face are in a mirror image relationship, this (111) face is called a twin plane. When this tabular grain is viewed from the above, the shape of the grain is an triangle, a hexagon, or a circle. Triangular, hexagonal, and circular grains have triangular, hexagonal, and circular parallel surfaces, respectively.

In the present invention, an average aspect ratio of tabular grains having a grain size of 0.1 μm or more is an average value of values obtained by dividing grain sizes of the grains by their thicknesses. The thickness of each grain can be easily measured as follows. That is, a metal is obliquely deposited on a grain and a latex as a reference, and the length of a shadow is measured on an electron micrograph, thereby calculating the thickness of the grain using the length of the shadow of the latex as a reference.

In the present invention, the grain diameter is a diameter of a circle having an area equal to a projected area of parallel surfaces of a grain.

The projected area of a grain can be obtained by measuring an area on an electron micrograph and correcting a photographing magnification.

The diameter of the tabular grain is preferably 0.15 to 5.0 μm. The thickness of the tabular grain is preferably 0.05 to 1.0 μm.

A ratio of the tabular grains in the total projected area is preferably 50% or more, more preferably, 80% or more, and most preferably, 90% or more.

More preferable result may be obtained by using monodisperse tabular grains. Although a structure and a method of manufacturing the monodisperse tabular grains are described in, e.g., JP-A-63-151618, a shape of the grain will be briefly described below. That is, 70% or more of the total projected area of silver halide grains are occupied by hexagonal tabular silver halide grains in which a ratio of the length of an edge having a maximum length to the length of an edge having a minimum length is 2 or less and which has two parallel faces as outer surfaces. The hexagonal tabular silver halide grains are monodisperse, i.e., have a variation coefficient (a value obtained by dividing a variation (standard deviation) in grain sizes represented by a circle-equivalent diameter of a projected area by an average grain size) in grain size distribution of 20% or less, and have an aspect ratio of 2.5 or more and a grain size of 0.2 μm or more.

The emulsion of the present invention preferably has a dislocation especially in a tabular grain.

A dislocation of a tabular grain can be observed by a direct method using a cryo-transmission electron microscope as described in, e.g., J. F. Hamilton, Phot. Sci. Eng., 11, 57, (1967) or T. Shiozawa, J. Soc. Phot. Sci. Japan, 35, 213, (1972). That is, a silver halide grain extracted from an emulsion so as not to apply a pressure which produces a dislocation in the grain is placed on a mesh for electron microscope observation, and observation is performed by a transmission method while a sample is cooled to prevent a damage (e.g., print out) caused by electron rays. In this case, since it becomes difficult to transmit electron rays as the thickness of a grain is increased, the grain can be observed more cearly by using a high-voltage (200 kV or more with respect to a grain having a thickness of 0.25 μm) electron microscope. By using photographs of grains obtained by this method, the positions and number of dislocations of each grain when the grain is vertically viewed with respect to the major face, can be obtained.

These dislocations may be formed throughout the entire major face or may be locally, selectively formed thereon.

In the emulsion of the present invention, a ratio of a projected area of the silver halide grains defined by the present invention in the total projected area of all the grains of the emulsion is preferably at least 50%, more preferably, 80% or more, and most preferably, 90% or more.

The emulsion of the present invention is preferably a negative type emulsion, and produces developed silver corresponding to an exposure amount.

The photographic emulsion for use in the present invention can be prepared by using methods described in, for example, P. Glafkides, "Chimie et Physique Photographique", Paul Montel, 1967; Duffin, "Photographic Emulsion Chemistry", Focal Press, 1966; and V. L. Zelikman et al., "Making and Coating Photographic Emulsion", Focal Press, 1964. That is, the photographic emulsion can be prepared by, e.g., an acid method, a neutral method, and an ammonia method. Also, as a system for reacting a soluble silver salt and a soluble halide, a single-jet method, a double-jet method, or a combination thereof can be used. Also, a so-called back mixing method for forming silver halide grains in the presence of excessive silver ions can be used. As one system of the double-jet method, a so-called controlled double-jet method wherein the pAg in the liquid phase in which the silver halide is produced, is kept at a constant value can be used. According to this method, a silver halide emulsion having a regular crystal form and almost uniform grain sizes is obtained.

The silver halide emulsion containing the above-described regular silver halide grains can be obtained by controlling the pAg and pH during grain formation. More specifically, such a method is described in "Photographic Science and Engineering", Vol. 6, 159–165

(1962); "Journal of Photographic Science", Vol. 12, 242–251 (1964); and U.S. Pat. Nos. 3,655,394 and 1,413,748.

The tabular grains can be easily prepared by methods described in, for example, Cleve, "Photography Theory and Practice", (1930), P. 131; Gutoff, "Photographic Science and Engineering", Vol. 14, PP. 248 to 257, (1970); and U.S. Pat. Nos. 4,434,226, 4,414,310, 4,433,048 and 4,439,520 and British Patent 2,112,157. When the tabular grain is used, covering power and an efficiency of spectral sensitizing by a sensitizing dye can be advantageously improved as described in detail in U.S. Pat. No. 4,434,226.

A silver halide having different compositions may be bonded by an epitaxial junction, or a compound other than a silver halide such as silver rhodanate or zinc oxide may be bonded.

In the grains of the present invention, the shape of a core and the entire shape with an outermost shell may be the same or different. More specifically, while the shape of a core is cubic, the shape of a grain with an outermost shell may be cubic or octahedral. To the contrary, while the core is octahedral, the grain with the outermost shell may be cubic or octahedral. In addition, although the core is a clear regular grain, the grain with the outermost shell may be slightly irregular or may not have any specific shape.

A boundary portion between different halogen compositions of a grain having the above structures may be a clear boundary or an unclear boundary by forming mixed crystals by a composition difference. Alternatively, the structure may be positively, continuously changed.

The silver halide emulsion for use in the present invention can be subjected to a treatment for rounding a grain as disclosed in, e.g., EP-0096727Bl and EP-0064412Bl or a treatment of modifying the surface of a grain as disclosed in DE-2306447C2 and JP-A-60-221320.

The silver halide emulsion for use in the present invention is preferably of a surface sensitive type. An internally sensitive emulsion, however, can be used by selecting a developing solution or development Conditions as disclosed in JP-A 59-133542. In addition, a shallow internally sensitive emulsion covered with a thin shell can be used in accordance with the desired application.

A solvent for silver halide can be effectively used to promote ripening. For example, in a known conventional method, an excessive amount of halide ions are supplied in a reaction vessel in order to promote ripening. Therefore, it is apparent that ripening can be promoted by only supplying a silver halide solution into a reaction vessel. In addition, another ripening agent can be used. In this case, a total amount of these ripening agents can be mixed in a dispersion medium in the reaction vessel before a silver salt and a halide are added therein, or they can be added in the reaction vessel together with one or more halides, a silver salt or a deflocculant. Alternatively, the ripening agents can be added before the steps of adding a halide and a silver salt.

Examples of the ripening agent other than the halide ion are ammonia, an amine compound and a thiocyanate such as an alkali metal thiocyanate, especially sodium or potassium thiocyanate and ammonium thiocyanate.

In a process of formation or physical ripening of silver halide grains of the silver halide emulsion of the present invention, a cadmium salt, a zinc salt, a thallium salt, an iridium salt or its complex salt, rhodium salt or its complex salt, and an iron salt or its complex salt, can coexist.

The emulsion of the present invention is sensitized by at least three types of different sensitizers, i.e., a selenium sensitizer, a gold sensitizer, and a sulfur sensitizer.

Selenium sensitization is performed by a conventional method. That is, an unstable selenium compound and/or a non-unstable (i.e. stable) selenium compound are/is added to an emulsion, and the emulsion is stirred at a high temperature of preferably 40° C. or more for a predetermined time period. Selenium sensitization using unstable selenium sensitizers described in JP-B-44-15748 is preferably performed. Examples of the unstable selenium sensitizer are aliphatic isoselenocyanates such as allylisoselenocyanate, selenoureas, selenoketones, selenoamides, seenocarboxylates, selenoesters, and selenophosphates. Most preferable examples of the unstable selenium compound are as follows.

I. Colloidal metal selenium

II. Organic selenium compound (in which a selenium atom is bonded by double bonding to a carbon atom of an organic compound by covalent bonding)

a. Isoselenocyanates e.g., an aliphatic isoselenocyanate such as allylisoselenocyanate b. Selenoureas (including an enol form) e.g., an aliphatic selenourea such as methyl, ethyl, propyl, isopropyl, butyl, hexyl, octyl, dioctyl, tetramethyl, N-(β-carboxyethyl)-N',N'-dimethyl, N,N-dimethyl, diethyl, and dimethyl selenourea; an aromatic selenourea having one or more aromatic groups such a phenyl and tolyl; a heterocyclic selenourea having a heterocyclic group such as pyridyl and benzothiazolyl c. Selenoketones e.g., selenoacetone, selenoacetophenone, selenoketone in which an alkyl group is bonded to >C=Se, and selenobenzophenone d. Selenoamides e.g., selenoacetoamide e. Selenocarboxylic acid and selenoester e.g., 2-selenopropionic acid, 3-selenobutyric acid, and methyl-3-selenobutyrate III. Others a. Selenides e.g., diethylselenide, diethyldiselenide, and triphenylphosphineselenide b. Selenophosphates e.g., tri-p-tolylselenophosphate and trinbutylselenophosphate Although the preferable types of the unstable selenium compound are enumerated above, the compound is not limited to the above examples. It is generally understood by those skilled in the art that the structure of the unstable selenium compound as a sensitizer of a photographic emulsion is not so important as long as selenium is unstable and that an organic portion of a selenium sensitizer molecule has no function except for a function of carrying selenium and allowing selenium to be present in an unstable state in an emulsion. In the present invention, the unstable selenium compound in such a wide range of general idea is effectively used.

Selenium sensitizations using non-unstable selenium sensitizers described in JP-B-46-4553, JP-B-52-34492, and JP-B-52-34491 can be also performed. Examples of the non unstable selenium compound are selenious acid, potassium selenocyanide, selenazoles, quaternary ammoniums salt of selenazoles, diarylselenide, diaryldiselenide, 2-thioselenazolizinedione, 2-selenooxozinethione, and derivatives of these compounds.

A non-unstable selenium sensitizer, a thioselenazolizinedione compound described in JP-B-52-38408 is also effective.

These selenium sensitizers are dissolved in water, an organic solvent such as methanol or ethanol, or a solvent mixture thereof and added upon chemical sensitization. Preferably, the sensitizers are added before chemical sensitization is started. The selenium sensitizers need not be used singly but may be used in combination of two or more types thereof. The unstable and non-unstable selenium compounds can be preferably used in combination.

Although an addition amount of the selenium sensitizer for use in the present invention differs in accordance with the activity of the selenium sensitizer, the types or size of the silver halide or the temperature and time of ripening, it is preferably $1\times10^{-8}$ mol or more, and more preferably, $1\times10^{-7}$ to $5\times10^{-5}$ mol per mol of a silver halide. When the selenium sensitizer is used, the temperature of chemical ripening is preferably 45° C. or more, and more preferably, 50° C. to 80° C. A pAg and a pH may take arbitrary values. For example, the effect of the present invention can be obtained throughout a wide pH range of 4 to 9.

In the present invention, selenium sensitization can be performed more effectively in the presence of a solvent for silver halide.

Examples of the solvent for silver halide which can be used in the present invention are (a) organic thioethers described in, e.g., U.S. Pat. Nos. 3,271,157, 3,531,289, and 3,574,628, JP-A-54-1019, and JP-A-54-158917; (b) thiourea derivatives described in, e.g., JP-A-53 82408, JP-A-55-77737, and JP-A-55-2982; (c) a solvent for silver halide, solvent having a thiocarbonyl group sandwiched by an oxygen or sulfur atom and a nitrogen atom described in JP-A 53-144319; (d) imidazoles; (e) sulfites; and (f) thiocyanates, described in JP-A-54-100717.

Practical compounds of the solvent are listed in Table 2.

Most preferable examples of the solvent are thiocyanate and tetramethylthiourea. An amount of the solvent differs in accordance with the type of the solvent. For example, a preferable amount of thiocyanate is $1\times10^{-4}$ to $1\times10^{-2}$ mol per mol of a silver halide.

TABLE 2

(a)

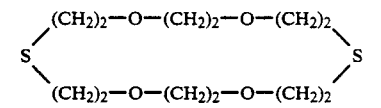

$HO-(CH_2)_2-S-(CH_2)_2-S-(CH_2)_2-OH$ $CH_2-NHCOCH_2CH_2COOH$
$|$
$CH_2-S-CH_2CH_2SC_2H_5$ (b)

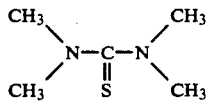

(c)

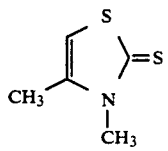

TABLE 2-continued (d)

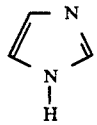

(e) $K_2SO_3$ (f) $NH_4SCN$, $KSCN$

In chemical sensitization of the emulsion of the present invention, sulfur sensitization and gold sensitization are performed in addition to selenium sensitization.

Sulfur sensitization is normally performed by adding a sulfur sensitizer to an emulsion and stirring the emulsion at a high temperature of preferably 40° C. or more for a predetermined time period.

Gold sensitization is normally performed by adding a gold sensitizer to an emulsion and stirring the emulsion at a high temperature of 40° C. or more for a predetermined time period.

Known compounds can be used as the sulfur sensitizer in sulfur sensitization. Examples of the sulfur sensitizer are thiosulfate, allylthiocarbamidethiourea, allylisothiacyanate, cystine, p-toluenethiosulfonate, and rhodanine. In addition, sulfur sensitizers described in, e.g., U.S. Pat. Nos. 1,574,944, 2,410,689, 2,278,947, 2,728,668, 3,501,313, and 3,656,955, West German Patent 1,422,869, JP-B-56-24937, and JP-A-55-45016 can be used. An addition amount of the sulfur sensitizer need only be an amount sufficient to effectively increase the sensitivity of the emulsion. Although the amount changes throughout a wide range in accordance with various conditions such as a pH, a temperature, and the size of a silver halide grain, it is preferably $1\times10^{-7}$ to $5\times10^{-5}$ mol per mol of a silver halide.

An oxidation number of gold of a gold sensitizer for use in gold sensitization of the present invention may be univalent (+1) or trivalent (+3), and gold compounds which are normally used as a gold sensitizer can be used in the present invention. Typical examples of the gold compound are chloroaurate, potassium chloroaurate, auricrichloride, potassium auricthiocyanate, potassium iodoaurate, tetracyanoauric acid, ammonium aurothiocyanate, and pyridyltrichorogold.

Although an addition amount of the gold sensitizer differs in accordance with various conditions, it is preferably $1\times10^{-7}$ to $5\times10^{-5}$ mol per mol of a silver halide.

In chemical ripening, addition times and an addition order of the solvent for silver halide, the selenium sensitizer, the sulfur sensitizer, and the gold sensitizer need not be particularly limited. For example, the above compounds can be added simultaneously or at different addition timings in (preferably) an initial stage of chemical ripening or during chemical ripening. The compounds are dissolved in water, an organic solvent which can be mixed in water, e.g. methanol, ethanol, and acetone, or a mixture thereof and added to an emulsion.

The silver halide emulsion of the present invention can be preferably subjected to reduction-sensitization during grain formation.

"To be subjected to reduction sensitization during grain formation of a silver halide emulsion" basically means that reduction sensitization is performed during nucleation, ripening, and precipitation. Reduction sensitization may be performed upon and step of nucleation physical ripening in the initial stage of grain formation, or precipitation. Most preferably, reduction sensitization is performed during growth of silver halide grains. "To perform reduction sensitization during formation of silver halide grains" includes a method of performing reduction sensitization while silver halide grains are physically ripened or precipitated by addition of water-soluble silver sat and water-soluble alkali halide, and a method of performing reduction sensitization while grain formation is temporarily stopped, and precipitation may be performed again.

Reduction sensitization includes any of a method of adding a known reduction sensitizer to a silver halide emulsion, a method called silver ripening in which grains are grown or ripened in a low-pAg atmosphere having a pAg of 1 to 7, and a method called high-pH ripening in which grains are grown or ripened in a high-pH atmosphere having a pH of 8 to 11. These methods can be used in combination of two or more thereof.

The method of adding a reduction sensitizer is preferable since the level of reduction sensitization can be finely controlled.

Examples of the reduction sensitizer are stannous chloride, amines and polyamines, hydrazine derivatives, formamidinesulfinic acid, a silane compound, and a borane compound. In the present invention, these compounds may be selectively used or used in combination of two or more types thereof. Preferable compounds as the reduction sensitizer are stannous chloride, thiourea dioxide, dimethylamineboran, ascorbic acid, and an ascorbic acid derivative. Although an addition amount of the reduction sensitizer depends on emulsion manufacturing conditions, it is preferably $10^{-8}$ to $10^{-3}$ mol per mol of a silver halide.

The reduction sensitizer can be dissolved in water or in a solvent such as an alcohol, a glycol, a ketone, an ester, or an amide and added during grain formation. Although the reduction sensitizer may be added to a reaction vessel beforehand, it is preferably added at an arbitrary timing during grain formation. The reduction sensitizer may be added to an aqueous solution of water-soluble silver salt or water-soluble alkali halide, and the resultant aqueous solution may be used in grain formation. In addition, a solution of a reduction sensitizer may be added continuously or a plurality of times as grain formation progresses.

More preferably, a palladium compound in an amount of $5\times10^{-5}$ mol or more, and preferably, $10^{-3}$ mol or less per mol of a silver halide is added to the silver halide emulsion of the present invention after grain formation is finished.

In this case, the palladium compound means a salt of divalent or tetravalent palladium. The palladium compound is preferably represented by $R_2PdX_6$ or $R_2PdX_4$ wherein R represents a hydrogen atom, an alkali metal atom, or an ammonium group and X represents a halogen atom, i.e., a chlorine, bromine, or iodine atom.

Preferable examples of the palladium compound are $K_2PdCl_4$, $(NH_4)_2PdCl_6$, $Na_2PdCl_4$, $(NH_4)2PdCl_4$, $Li_2PdCl_4$, $Na_2PdCl_6$, and $K_2PdBr_4$.

Most preferably, the palladium compound is used in combination with thiocyanate ions in an amount five times that of the palladium compound.

The silver halide emulsion of the present invention is preferably spectrally sensitized and used.

A methine dye is normally used as a spectral sensitizing dye for use in the present invention. The methine dye includes a cyanine dye, a merocyanine dye, a complex cyanine dye, a complex merocyanine dye, a holopolar cyanine dye, a hemicyanine dye, a styryl dye, and a hemioxonol dye. In these dyes, any nucleus normally used as a basic heterocyclic nucleus in cyanine dyes can be used. Examples of the nucleus are pyrroline, oxazoline, thiazoline, pyrrole, oxazole, thiazole, selenazole, imidazole, tetrazole, and pyridine; a nucleus obtained by fusing an alicyclic hydrocarbon ring to each of the above nuclei; and a nucleus obtained by fusing an aromatic hydrocarbon ring to each of the above nuclei, e.g., indolenine, benzindolenine, indole, benzoxadole, naphthooxadole, benzothiazole, naphthothiazole, benzoselenazole, benzimidazole, and quinoline. These nuclei may have a substituent group on a carbon atom.

For a merocyanine dye or complex merocyanine dye, a 5- or 6-membered heterocyclic nucleus, e.g., pyrazoline-5-one, thiohydantoin, 2-thiooxazoline-2,4-dione, thiazoline-2,4-dione, rhodanine, or thiobarbituric acid can be used as a nucleus having a ketomethylene structure.

Of the above dyes, a dye most effectively used in the present invention is a cyanine dye. An example of a cyanine dye effectively used in the present invention is a dye represented by the following formula (I):

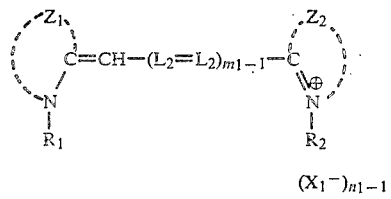

Formula (I)

wherein $Z_1$ and $Z_2$ independently represent an atom group required to complete a heterocyclic nucleus normally used in a cyanine dye, such as thiazole, thiazoline, benzothiazole, naphthothiazole, oxazole, oxazoline, benzoxazole, naphthoxazole, tetrazole, pyridine, quinoline, imidazoline, imidazole, benzoimidazole, naphthimidazole, selenazoline, selenazole, benzoselenazole, naphthoselenazole, or indolenine. These nuclei may be substituted by a lower alkyl such as methyl, a halogen atom, phenyl, hydroxyl, alkoxy having 1 to 4 carbon atoms, carboxyl, alkoxycarbonyl, alkylsulfamoyl, alkylcarbamoyl, acetyl, acetoxy, cyano, trichloromethyl, trifluoromethyl, and nitro group.

$L_1$ or $L_2$ represents a methine group and a substituted methine group. Examples of the substituted methine group are a methine group substituted by a lower alkyl group such as methyl and ethyl, phenyl, substituted phenyl, methoxy, and ethoxy.

$R_1$ and $R_2$ independently represent an alkyl group having 1 to 5 carbon atoms; a substituted alkyl group having a carboxy group; a substituted alkyl group having a sulfo group e.g. β-sulfoethyl, γ-sulfopropyl, δ-sulfobutyl, 2-(3-sulfopropoxy)ethyl, 2-[2 (sulfopropoxy)ethoxy]ethyl, and 2-hydroxysulfopropyl, an allyl group or a substituted alkyl group normally used as an N-substituting group of a cyanine dye. $m_1$ represents 1, 2, or 3. $X_1^-$ represents an acid anion group normally used in a cyanine dye such as an iodide ion, a bromide ion, a p-toluenesulfonate ion, or a perchlorate ion. $n_1$ represents 1 or 2. When a betaine structure is adopted, $n_1$ represents 1.

Other examples of the spectral sensitizing dye which can be used are described in, e.g., West German Patent 929,080, U.S. Pat. Nos. 2,493,748, 2,503,776, 2,519,001, 2,912,329, 3,656,956, 3,672,897, 3,694,217, 4,025,349, 4,046,572, 2,688,545, 2,977,229, 3,397,060, 3,552,052, 3,527,641, 3,617,293, 3,628,964, 3,666,480, 3,672,898, 3,679,428, 3,703,377, 3,814,609, 3,837,862, and 4,026,344, British Patents 1,242,588, 1,344,281, and 1,507,803, JP-B-44-14,030, JP-B-52-24,844, JP-B-43-4936, JP-B-53-12,375, JP-A-52-110,618, JP A-52-109,925, and JP-A-50-80,827.

An amount of the sensitizing dye to be added during preparation of the silver halide emulsion differs in accordance with the type of additive or a silver halide amount. However, substantially the same amount as that added in conventional methods can be used.

That is, an addition amount of the sensitizing dye is preferably 0.001 to 100 mmol, and more preferably, 0.01 to 10 mmol per mol of silver halide.

The sensitizing dye is added after or before chemical ripening. For the silver halide grains of the present invention, the sensitizing dye is most preferably added during chemical ripening or before chemical ripening (e.g., during grain formation or before physical ripening).

In addition to the sensitizing dye, a dye not having a spectral sensitizing effect or a substance essentially not absorbing visible light but exhibiting supersensitization may be contained in the emulsion. Examples of the substance are an aminostyl compound substituted by a nitrogen-containing heterocyclic group (described in, e.g., U.S. Pat. Nos. 2,933,390 or 3,635,721), an aromatic organic acid formaldehyde condensate (described in, e.g., U.S. Pat. No. 3,743,510), cadmium salt, and an azaindene compound. Combinations described in U.S. Pat. Nos. 3,615,613, 3,615,641, 3,617,295, and 3,635,721 are most effective.

The photographic emulsion for use in the present invention can contain various compounds in order to prevent fogging during manufacture, storage, or photographic processing of the light-sensitive material or to stabilize photographic properties. That is, many compounds known as an antifoggant or stabilizer can be used and Examples are azoles such as benzothiazolium salt, nitroindazoles, triazoles, benzotriazoles, and benzimidazoles (especially substituted by a nitro-or a halogen); heterocyclic mercapto compounds such as mercaptothiazoles, mercaptobenzothiazoles, mercaptobenzimidazoles, mercaptothiazoles,mercaptotetrazoles (especially 1-phenyl-5-mercaptotetrazole), and mercaptopyrimidines; these heterocyclic mercapto compounds having a water-soluble group such as carboxyl or sulfone; thioketo compounds such as oxazolinethione; an azaindene such as tetraazaindenes (especially a 4-hydroxy-substituted(1,3,3a,7) tetraazaindene); a benzenethiosulfonic acids; and benzenesulfinic acids.

Although these antifoggants or stabilizers are normally added after chemical ripening is performed, they may be more preferably added during chemical ripening or before start of chemical ripening. That is, in a silver halide emulsion grain formation process, the antifoggants or stabilizers can be added during addition of a silver salt solution, after the addition and before start of chemical ripening, or during chemical ripening (within preferably 50%, and more preferably, 20% of a chemical ripening time from the start of chemical ripening).

More specifically, examples are a hydroxyazaindene compound, a benzotriazole compound, and a heterocyclic compound substituted by at least one mercapto group and having at least two aza-nitrogen atoms in a molecule.

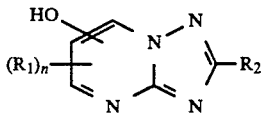

Formula (II)

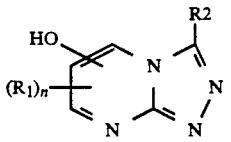

Formula (III)

wherein $R_1$ and $R_2$ may be the same or different and independently represent a hydrogen atom; an aliphatic moiety (an alkyl group (e.g., methyl, ethyl, propyl, pentyl, hexyl, octyl, isopropyl, sec-butyl, t-butyl, cyclohexyl, cyclopentylmethyl, and 2-norbornyl); an alkyl group substituted by an aromatic moiety (e.g., benzyl, phenethyl, benzhydryl, 1-naphthylmethyl, and 3 phenylbutyl); an alkyl group substituted by an alkoxy group (e.g., methoxymethyl, 2-methoxyethyl, 3 ethoxypropyl, and 4-methoxybutyl); an alkyl group substituted by a hydroxy group, a carbonyl group, or an alkoxycarbonyl group (e.g., hydroxymethyl, 2-hydroxymethyl, 3-hydroxybutyl, carboxymethyl, 2-carboxyethyl, and 2-(methoxycarbonyl)ethyl] or an aromatic moiety [an aryl group (e.g., phenyl and 1-naphthyl); an aryl group having a substituting group (e.g., p-tolyl, m-ethylphenyl, m-cumenyl, mesityl, 2,3-xylyl, p-chlorophenyl, o-bromophenyl, p-hydroxyphenyl, 1-hydroxy-2-naphthyl, m-methoxyphenyl, p-ethoxyphenyl, p-carboxyphenyl, o-(methoxycarbonyl)phenyl, m-(ethoxycarbonyl)-phenyl, and 4-carboxy-1-naphthyl)).

The total number of carbon atoms of $R_1$ and $R_2$ is preferably 12 or less.

n represents 1 or 2.

Examples of a hydroxytetraazaindene compound represented by formula (II) or (III) will be listed below. However, the compound for use in the emulsion of the present invention is not limited to the following examples.

II-1 4-hydroxy-6-methyl-1,3,3a,7-tetraazaindene
II-2 4-hydroxy-1,3,3a,7-tetraazaindene
II-3 4-hydroxy-6-methyl-1,2,3a,7-tetraazaindene
II-4 4-hydroxy-6-phenyl-1,3,3a,7-tetraazaindene
II-5 4-methyl-6-hydroxy-1,3,3a,7-tetraazaindene
II-6 2,6-dimethyl-4-hydroxy-1,3,3a,7-tetraazaindene
II-7 4-hydroxy-5-ethyl-6 methyl-1,3,3a,7-tetraazaindene
II-8 2,6-dimethyl-4-hydroxy-5-ethyl-1,3,3a,7-tetraazaindene
II-9 4-hydroxy-5,6-dimethyl-1,3,3a,7-tetraazaindene
II-10 2,5,6-trimethyl-4-hydroxy-1,3,3a,7-tetraazaindene
II-11 2-methyl-4-hydroxy-6-phenyl-1,3,3a,7-tetraazaindene
II-12 4-hydroxy-6-ethyl-1,2,3a,7-tetraazaindene
II 13 4-hydroxy-6-phenyl-1,2,3a,7-tetraazaindene
II-14 4-hydroxy-1,2,3a,7-tetraazaindene
II-15 4-methyl-6-hydroxy-1,2,3a,7-tetraazaindene
II-16 5,6 trimethylene-4-hydroxy-1,3,3a,7-tetraazaindene An example of a benzotriazole compound is a compound represented by the following formula (IV):

Formula (IV)

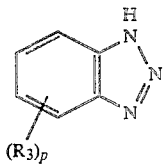

wherein p represents 0 or an integer of 1 to 4 and $R_3$ represents a halogen atom (chlorine, bromine, or iodine) or an aliphatic group (including saturated and nonsaturated aliphatic groups), e.g., a nonsubstituted alkyl group preferably having 1 to 8 carbon atoms (e.g., methyl, ethyl, n-propyl, or hexyl); a substituted alkyl group in which the alkyl radical (moiety) preferably has 1 to 4 carbon atoms, e.g., vinylmethyl, aralkyl (e.g., benzyl or phenethyl), hydroxyalkyl (e.g., 2-hydroxyethyl, 3-hydroxypropyl, or 4-hydroxybutyl), an acetoxyalkyl group (e.g., 2-acetoxyethyl or 3-acetoxypropyl), an alkoxyalkyl group (e.g., 2-methoxyethyl or 4-methoxybutyl); or an aryl group (e.g., phenyl). More preferably, $R_3$ is a halogen atom (chlorine or iodine) or an alkyl group having 1 to 3 carbon atoms (methyl, ethyl, or propyl).

Examples of a benzotriazole compound for use in the emulsion of the present invention will be listed below. However, the benzotriazole compound used in the method of the present invention is not limited to the following compounds.

Compound IV-1 benzotriazole
Compound IV-2 5-methyl-benzotriazole
Compound IV-3 5,6-dimethylbenzotriazole
Compound IV-4 5-bromobenzotriazole
Compound IV-5 5-chlorobenzotriazole
Compound IV-6 5-nitrobenzotriazole
Compound IV-7 4-nitro-6-chlorobenzotriazole
Compound IV-8 5-nitro-6-chlorobenzotriazole A heterocyclic compound substituted by at least one mercapto group and having at least two aza-nitrogen atoms in a molecule (to be referred to as a nitrogen-containing heterocyclic compound having a mercapto group hereinafter) will be described below. A heterocyclic ring of such a compound may have different types of atoms except for a nitrogen atom such as an oxygen atom, a sulfur atom, and a selenium atom. A preferable compound is a 5- or 6-membered monocyclic-heterocyclic compound having at least two aza-nitrogen atoms or a 2- or 3-cyclic-heterocyclic compound which is obtained by condensing two or three heterocyclic rings each having at least one aza-nitrogen atom, in which a mercapto group is substituted on a carbon atom adjacent to an aza-nitrogen.

In the nitrogen-containing heterocyclic compound having a mercapto group which can be used in the present invention, examples of the heterocyclic ring are pyrazole, 1,2,4-triazole, 1,2,3-triazole, 1,3,4-thiadiazole, 1,2,3-thiadiazole, 1,2,4-thiadiazole, 1,2,5-thiadiazole, 1,2,3,4-tetrazole, pyridazine, 1,2,3-triazine, 1,2,4-triazine, 1,3,5-triazine, and a ring obtained by condensing two or three of the above rings, e.g., triazolotriazole, diazaindene, triazaindene, tetraazaindene, and pentaazaindene. In addition, a heterocyclic ring obtained by condensing a monocyclic-heterocyclic ring and an aromatic ring, e.g., a phthalazine ring and an indazole ring can be used.

Of these rings, preferable rings are 1,2,4-triazole, 1,3,4-thiadiazole, 1,2,3,4-tetrazole, 1,2,4-triazine, triazolotriazole, and tetrazaaindene.

Although a mercapto group may be substituted on any carbon atom of the ring it is preferable that the following bonds are formed.

a) 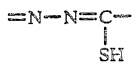

b) 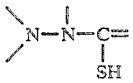

c) 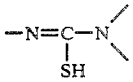

The heterocyclic ring may have a substituting group other than the mercapto group. Examples of the substituting group are an alkyl group having 8 or less carbon atoms (e.g., methyl, ethyl, cyclohexyl, and cyclohexylmethyl), a substituted alkyl group (e.g., sulfoethyl and hydroxymethyl), an alkoxy group having 8 or less carbon atoms (e.g., methoxy and ethoxy), an alkylthio group having 8 or less carbon atoms (e.g., methylthio and butylthio), a hydroxy group, an amino group, a hydroxyamino group, an alkylamino group having 8 or less carbon atoms (e.g., methylamino and butylamino), a dialkylamino group having 8 or less carbon atoms (e.g., dimethylamino and diisopropylamino), an arylamino group (e.g., anilino), an acylamino group (e.g., acetylamino), a halogen atom (e.g., chlorine and bromine), cyano, carboxy, sulfo, sulfato, and phosphor.

Examples of the nitrogen-containing heterocycli compound having a mercapto group which can be used in the present invention will be listed in Table 3. However, the compound is not limited to these examples.

Although an addition amount of the antifoggant or stabilizer for use in the present invention differs in accordance with an addition method or a silver halide amount, it is preferably $10^{-7}$ to $10^{-2}$ mol, and more preferably, $10^{-5}$ to $10^{-2}$ mol per mol of a silver halide.

TABLE 3

V-1 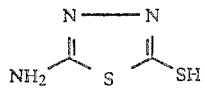

V-2 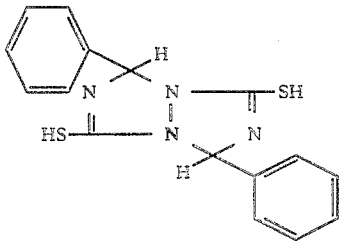

V-3 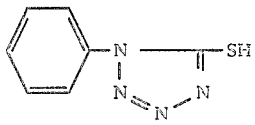

TABLE 3-continued

V-4

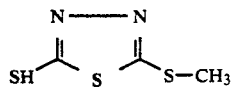

V-5

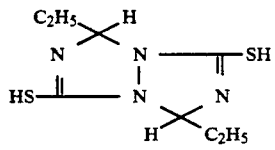

V-6

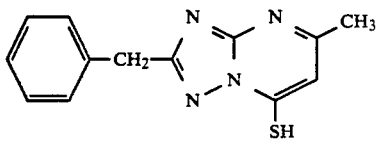

V-7

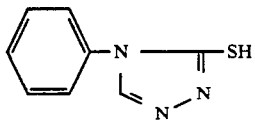

V-8

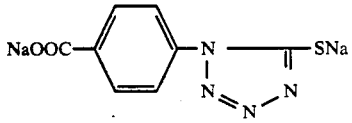

The photographic emulsion of the present invention can be applied to various types of color and black and white light-sensitive materials. Typical examples are a color negative film for a general purpose or a movie, a color reversal film for a slide or a television, color paper, a color positive film and color reversal paper, a color diffusion transfer type light-sensitive material, and a thermal development type color light-sensitive material.

The photographic emulsion of the present invention can also be applied to a film for reprophotography such as a litho-film or a scanner film, a direct/indirect medical or industrial X ray film, a negative black and white film for photographing, black and white print paper, a micro film for a COM or a general purpose, a silver salt diffusion transfer type light-sensitive material, and a print out type light-sensitive material.

A color light-sensitive material to which the photographic emulsion of the present invention is applied need only have at least one of silver halide emulsion layers, i.e., a blue-sensitive layer, a green-sensitive layer, and a red-sensitive layer or a layer sensitive to infrared light, on a support. The number or order of the silver halide emulsion layers and the non-light-sensitive layers are particularly not limited. A typical example is a silver halide photographic light-sensitive material comprising, on a support, at least one light-sensitive layer constituted by a plurality of silver halide emulsion layers which are sensitive to substantially the same color but has different sensitivities. This light-sensitive material is effectively used as a light-sensitive material having an improved exposure latitude for photographing. In a multilayered silver halide color photographic light-sensitive material, unit light-sensitive layers are generally arranged such that red-, green , and blue-sensitive layers are arranged from a support side in the order named. However, this order may be reversed or a layer sensitive to one color may be sandwiched between layers sensitive to another color in accordance with the desired application.

Non-light-sensitive layers such as various types of interlayers may be formed between the silver halide light-sensitive layers and as an uppermost layer and a lowermost layer.

The interlayer may contain, e.g., couplers and DIR compounds as described in JP-A-61-43748, JP-A-59-113438, JP-A-59-113440, JP-A-61-20037, and JP A-61-20038 or a color mixing inhibitor which is normally used.

As a plurality of silver halide emulsion layers constituting each unit light sensitive layer, a two-layered structure of high- and low-sensitivity emulsion layers can be preferably used as described in West German Patent 1,121,470 or British Patent 923,045. In this case, generally, layers are preferably arranged such that the sensitivity is sequentially decreased toward a support, and a non-light-sensitive layer may be formed between the silver halide emulsion layers. In addition, as described in JP-A-57-112751, JP-A-62-200350, JP-A-62-206541, and JP-A-62-206543, layers may be arranged such that a low-sensitivity emulsion layer is formed remotely from a support and a high-sensitivity layer is formed close to the support.

Specifically, layers may be arranged from the farthest side from a support in an order of low-sensitivity blue-sensitive layer (BL)/high-sensitivity blue-sensitive layer (BH)/high-sensitivity green-sensitive layer (GH)/low-sensitivity green-sensitive layer (GL)/high-sensitivity red-sensitive layer (RH)/low-sensitivity red-sensitive layer (RL), an order of BH/BL/GL/GH/RH/RL, or an order of BH/BL/GH/GL/RL/RH.

In addition, as described in JP-B-55-34932, layers may be arranged from the farthest side from a support in an order of blue-sensitive layer/GH/RH/GL/RL. Further more, as described in JP A-56-25738 and JP-A-62-63936, layers may be arranged from the farthest side from a support in an order of blue-sensitive layer/GL/RL/GH/RH.

As described in JP-B-49-15495, three layers may be arranged such that a silver halide emulsion layer having high sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer, i.e., three layers having different sensitivities may be arranged such that the sensitivity is sequentially decreased toward the support. Also when constituted by three layers having different sensitivities described above, these layers, in a layer sensitive to one color may be arranged in an order of medium-sensitivity emulsion layer/high-sensitivity emulsion layer/low-sensitivity emulsion layer from the farthest side from a support, as described in JP-A-59-202464.

In addition, an order of high-sensitivity emulsion layer/low-sensitivity emulsion layer/medium-sensitivity emulsion layer or low sensitivity emulsion layer/medium-sensitivity emulsion layer/high-sensitivity emulsion layer may be adopted.

In order to improve color reproducibility, as described in U.S. Pat. Nos. 4,663,271, 4,705,744, and 4,707,436, JP-A-62-160448, and JP-A-63-89580, a donor layer (CL) with an interlayer effect having a spectral sensitivity distribution different from those of main light-sensitive layers such as BL, GL, and RL is preferably arranged adjacent to or close to the main light-sensitive layers.

When the present invention is applied to a color negative film or a color reversal film, a preferable silver halide to be contained in a photographic emulsion layer is silver iodobromide, silver iodochloride, or silver iodochlorobromide containing about 30 mol % or less of average silver iodide. A most preferable silver halide is silver iodobromide or silver iodochlorobromide containing about 2 mol % to about 25 mol % of average silver iodide.

Although an average grain size of the photographic emulsion of the present invention can be arbitrarily set, a projected area diamether is preferably 0.5 to 4μ. The emulsion may be a multidisperse or monodisperse emulsion.

Known photographic additives which can be used together with the photographic emulsion of the present invention are described in two Research Disclosures, and they are summarized in the following table.

| | Additives | RD No. 17643 | RD No. 18716 |
|---|---|---|---|
| 1. | Chemical sensitizers | page 23 | page 648, right column |
| 2. | Sensitivity increasing agents | | do |
| 3. | Spectral sensitizers super sensitizers | pages 23–24 | page 648, right column to page 649, right column |
| 4. | Brighteners | page 24 | |
| 5. | Antifoggants and stabilizers | pages 24–25 | page 649, right column |
| 6. | Light absorbent, filter dye, ultra-violet absorbents | pages 25–26 | page 649, right column to page 650, left column |
| 7. | Stain preventing agents | page 25, right column | page 650, left to right columns |
| 8. | Dye image stabilizer | page 25 | |
| 9. | Hardening agents | page 26 | page 651, left column |
| 10. | Binder | page 26 | do |
| 11. | Plasticizers, lubricants | page 27 | page 650, right column |
| 12. | Coating aids, surface active agents | pages 26–27 | do |
| 13. | Antistatic agents | page 27 | do |

In order to prevent degradation in photographic properties caused by formaldehyde gas, a compound which can react with and fix formaldehyde described in U.S. Pat. Nos. 4,411,987 or 4,435,503 is preferably added to the light-sensitive material.

The photographic emulsion of the present invention is preferably used in a color light-sensitive material, and various color couplers can be used. Specific examples of these couplers are described in above-described Research Disclosure (RD), No. 17643, VII-C to VII-G as patent references.

Preferred examples of a yellow coupler are described in, e.g., U.S. Pat. Nos. 3,933,501, 4,022,620, 4,326,024, 4,401,752, and 4,248,961, JP-B-58-10739, British Patents 1,425,020 and 1,476,760, U.S. Pat. Nos. 3,973,968, 4,314,023, and 4,511,649, and EP 249,473A.

Examples of a magenta coupler are preferably 5-pyrazolone and pyrazoloazole compounds, and more preferably, compounds described in, e.g., U.S. Pat. Nos. 4,310,619 and 4,351,897, EP 73,636, U.S. Pat. Nos. 3,061,432 and 3,725,067, Research Disclosure No. 24220 (June 1984), JP-A-60-33552, Research Disclosure No. 24230 (June 1984), JP-A-60-43659, JP-A 61-72238, JP-A-60-35730, JP-A-55-118034, and JP-A-60-185951, U.S. Pat. Nos. 4,500,630, 4,540,654, and 4,565,630, and WO No. 04795/88.

Examples of a cyan coupler are phenol and naphthol couplers, and preferably, those described in, e.g., U.S. Pat. Nos. 4,052,212, 4,146,396, 4,228,233, 4,296,200, 2,369,929, 2,801,171, 2,772,162, 2,895,826, 3,772,002, 3,758,308, 4,343,011, and 4,327,173, EP Disclosure 3,329,729, EP 121,365A and 249,453A, U.S. Pat. Nos. 3,446,622, 4,333,999, 4,775,616, 4,451,559, 4,427,767, 4,690,889, 4,254,212, and 4,296,199, and JP-A-61-42658.

Preferable examples of a colored coupler for correcting additional, undesirable absorption of a colored dye are those described in Research Disclosure No. 17643, VII G, U.S. Pat. No. 4,163,670, JP-B-57-39413, U.S. Pat. Nos. 4,004,929 and 4,138,258, and British Patent 1,146,368. A coupler for correcting unnecessary absorption of a colored dye by a fluorescent dye released upon coupling, described in U.S. Pat. No. 4,774,181, or a coupler having a dye precursor group, which can react with a developing agent to form a dye, as a split-off group, described in U.S. Pat. No. 4,777,120 may be preferably used.

Preferable examples of a coupler capable of forming colored dyes having proper diffusibility are those described in U.S. Pat. No. 4,366,237, British Patent 2,125,570, EP 96,570, and West German Patent Application (OLS) No. 3,234,533.

Typical examples of a polymerized dye-forming coupler are described in U.S. patents 3,451,820, 4,080,221, 4,367,288, 4,409,320, and 4,576,910, and British Patent 2,102,173.

Couplers releasing a photographically useful residue upon coupling are preferably used in the present invention. DIR couplers, i.e., couplers releasing a development inhibitor are described in the patents cited in the above-described Research Disclosure No. 17643, VII-F, JP-A 57-151944, JP-A-57-154234, JP-A-60-184248, JP-A-63-37346, JP-A-63-37350, and U.S. Pat. Nos. 4,248,962 and 4,782,012.

Examples of a coupler which can be used in the light-sensitive material of the present invention are competing couplers described in, e.g., U.S. Pat. No. 4,130,427; poly-equivalent couplers described in, e.g., U.S. Pat. Nos. 4,283,472, 4,338,393, and 4,310,618; a DIR redox compound releasing coupler, a DIR coupler releasing coupler, a DIR coupler releasing redox compound, or a DIR redox releasing redox compound described in, e.g., JP-A-60-185950 and JP-A-62-24252; couplers releasing a dye which turns to a colored form after being released described in EP 173,302A and 313,308A; bleaching accelerator releasing couplers described in, e.g., RD. Nos. 11449 and 24241 and JP-A-61-201247; a legand releasing coupler described in, e.g., U.S. Pat. No. 4,553,477; a coupler releasing a leuco dye described in JP-A-63-75747; and a coupler releasing a fluorescent dye described in U.S. Pat. No. 4,774,181.

Various types of an antiseptic agent or a mildew-proofing agent are preferably added to the color light-sensitive material of the present invention. Examples of the antiseptic agent and the mildewproofing agent are 1,2-banzisothiazoline-3-one, n-butyl-p-hydroxybenzoate, phenol, 4-chloro-3,5-dimethylphenol, 2-phenoxyethanol, and 2-(4-thiazolyl)benzimidazole described in JP-A-63-257747, JP-A-62-272248, and JP-A-1-80941.

A support which can be suitably used in the present invention is described in, e.g., RD. No. 17643, page 28 and RD. No. 18716, from the right column, page 647 to the left column, page 648.

In the light-sensitive material using the photographic emulsion of the present invention, the sum total of film thicknesses of all hydrophilic colloidal layers at the side having emulsion layers is preferably 28 μm or less, more preferably, 23 μm or less, and most preferably, 20 μm or less. A film swell speed $T_{\frac{1}{2}}$ is preferably 30 sec. or less, and more preferably, 20 sec. or less. The film thickness means a film thickness measured under moisture conditioning at a temperature of 25° C. and a relative humidity of 55% (two days). The film swell speed $T_{\frac{1}{2}}$ can be measured in accordance with a known method in the art. For example, the film swell speed $T_{\frac{1}{2}}$ can be measured by using a swell meter described in Photographic Science & Engineering, A. Green et ai., Vol. 19, No. 2, pp. 124 to 129. When 90% of a maximum swell film thickness reached by performing a treatment by using a color developer at 30° C. for 3 min. and 15 sec. is defined as a saturated film thickness, $T_{\frac{1}{2}}$ is defined as a time required for reaching ½ of the saturated film thickness.

A film swell speed $T_{\frac{1}{2}}$ can be adjusted by adding a film hardening agent to gelatin as a binder or changing aging conditions after coating. A swell ratio is preferably 150% to 400%. The swell ratio is calculated from the maximum swell film thickness measured under the above conditions in accordance with a relation of (maximum swell film thickness—film thickness)/film thickness.

The color photographic light-sensitive material according to the present invention can be developed by conventional methods described in RD. No. 17643, pp. 28 and 29 and RD. No. 18716, the left to right columns, page 615.

In order to perform reversal development, in general, black-and-white development is performed and then color development is performed. As a black-and-white developer, known black-and-white developing agents, e.g., dihydroxybenzenes such as hydroquinone, 3-pyrazolidones such as 1-phenyl-3-pyrazolidone, and aminophenols such as N-methyl-p-aminophenol can be used singly or in a combination of two or more thereof.

The photographic light-sensitive material of the present invention is normally subjected to washing and/or stabilizing steps after desilvering. An amount of water used in the washing step can be arbitrarily determined over a broad range in accordance with the properties (e.g., a property determined by used material such as coupler) of the light-sensitive material, the application of the material, the temperature of the water, the number of water tanks (the number of stages), a replenishing scheme representing a counter or forward current, and other conditions. The relationship between the amount of water and the number of water tanks in a multi-stage counter-current scheme can be obtained by a method described in "Journal of the Society of Motion Picture and Television Engineers", Vol. 64, PP. 248-253 (May, 1955).

According to the above-described multi-stage counter-current scheme, the amount of water used for washing can be greatly decreased. Since washing water stays in the tanks for a long period of time, however, bacteria multiply and floating substances may be undesirably attached to the light-sensitive material. In order to solve this problem in the process of the color photographic light-sensitive material of the present invention, a method of decreasing calcium and magnesium ions can be effectively utilized, as described in JP-A-62-288838. In addition, a germicide such as an isothiazolone compound and cyabendazole described in JP-A-57-8542, a chlorine-based germicide such as sodium chlorinated isocyanurate, and germicides such as benzotriazole described in Hiroshi Horiguchi, "Chemistry of Antibacterial and Antifungal Agents", (1986), Eiseigijutsu-Kai ed., "Sterilization, Antibacterial, and Antifungal Techniques for Microorganisms", (1982), and Nippon Bokin Bokabi Gakkai ed., "Dictionary of Antibacterial and Antifungal Agents".

The pH of the water for washing the photographic light-sensitive material of the present invention is 4 to 9, and preferably, 5 to 8. The water temperature and the washing time can vary in accordance with the properties and applications of the light-sensitive material. Normally, the washing time is 20 seconds to 10 minutes at a temperature of 15° C. to 45° C., and preferably, 30 seconds to 5 minutes at 25° C. to 40° C. The light-sensitive material of the present invention can be processed directly by a stabilizing agent in place of washing. All known methods described in JP-A-57-8543, JP-A-58-14834, and JP-A-60-220345 can be used in such stabilizing processing.

Stabilizing is sometimes performed subsequently to washing. An example is a formalin bath used as a final bath of a photographic color light-sensitive material.

The present invention will be described in more detail below by way of its examples, but the present invention is not limited to those examples.

EXAMPLE-1

Emulsion 1 (Formation of Seed Crystal)

A solution obtained by dissolving 30 g of inert gelatin, 0.76 g of potassium bromide, and 5 ml of a 25% aqueous ammonia solution in 1 l of distilled water was stirred at 60° C., and 600 ml of a 0.98 M aqueous silver nitrate solution were added to the solution over 50 minutes. A 0.98 M aqueous potassium bromide solution was added to the resultant solution five minutes after addition of the aqueous silver nitrate solution was started, thereby controlling the pBr to be 1.8.

Thereafter, the above emulsion was cooled to 35° C. and washed by a flocculation method, and 50 g of inert gelatin were added to the emulsion, then the pH and the pAg were adjusted to be 6.5 and 8.6, respectively, at a temperature of 40° C.

Emulsion 1 comprises octahedral grains having a sphere-equivalent diameter of 0.73 μm and a variation coefficient of 15%.

Emulsions 2-9

The following solutions were used to prepare emulsions 2 to 9.

| | | |
|---|---|---|
| Solution A | $AgNO_3$ | 170 g |
| | $H_2O$ | 830 cc |
| Solution B | KBr | 119 g |
| | $H_2O$ | 881 cc |
| Solution C | KBr | 115.43 g |
| | KI | 4.98 g |
| | $H_2O$ | 879.6 cc |
| Solution D | KBr | 111.86 g |
| | KI | 9.96 g |
| | $H_2O$ | 878.2 cc |
| | KBr | 108.29 g |

-continued

| | | |
|---|---|---|
| Solution E | KI | 14.94 g |
| | $H_2O$ | 876.8 cc |
| Solution F | KBr | 107.1 g |
| | KI | 16.6 g |
| | $H_2O$ | 876.3 cc |
| Solution G | KBr | 104.72 g |
| | KI | 19.92 g |
| | $H_2O$ | 875.4 cc |
| Solution H | KBr | 95.2 g |
| | KI | 33.2 g |
| | $H_2O$ | 871.6 cc |

Emulsion 2

1 l of distilled water and 15 ml of an aqueous potassium thiocyanate solution (2 N) were added to 556 g (containing 75 g of AgBr grains) of the seed emulsion 1.

441 g of the solution A and the solution B were added to the resultant solution mixture by a controlled double jet method over 50 minutes. The flow rate of the solution B was controlled to obtain a pBr of 2.5 The temperature of the solution mixture was maintained at 75° C.

After the addition, the prepared emulsion was washed by a flocculation method, and 50 g of inert gelatin were added to the emulsion, then the pH and the pAg were adjusted to be 5.0 and 8.6, respectively, at a temperature of 40° C. The obtained grains were octahedral grains having a sphere-equivalent diameter of 0.92 μm.

Emulsion 3

1 l of distilled water and 15 ml of an aqueous potassium thiocyanate solution (2 N) were added to 444 g of the seed emulsion 1. 265 g of the solution A and the solution D were added to the resultant solution mixture by a controlled double jet method over 25 minutes while the temperature of the solution mixture was maintained at 75° C. During this addition, the flow rate of the solution D was controlled such that the pBr of the solution mixture was 3.00. Thereafter, 265 g of the solution A and the solution C were added to the resultant solution mixture by the controlled double jet method over 25 minutes. During this addition, the flow rate of the solution C was controlled such that the pBr of the solution mixture was 3.00.

After the addition, the prepared emulsion was washed by a flocculation method, and 50 g of inert gelatin were added to the emulsion, then a pH and the pAg were adjusted to be 5.0 and 8.6, respectively, at a temperature of 40° C. The obtained grains were octahedral grains having a sphere-equivalent diameter of 0.99 μm.

Emulsion 4

1 l of distilled water and 15 ml of an aqueous potassium thiocyanate solution (2 N) were added to 444 g of the seed emulsion 1. 265 g of the solution A and the solution D were added to the resultant solution mixture by a controlled double jet method over 25 minutes while the temperature of the solution mixture was maintained at 75° C. During this addition, the flow rate of the solution D was controlled such that the pBr of the solution mixture was 3.00. Thereafter, 265 g of the solution A and the solution F were added to the resultant solution mixture by the controlled double jet method over 25 minutes. The flow rate of the solution F was controlled such that the pBr of the solution mixture was 3.00.

After the addition, the prepared emulsion was washed by a flocculation method, and 50 g of inert gelatin were added to the emulsion, then the pH and the pAg were adjusted to be 5.0 and 8.6, respectively, at a temperature of 40° C. The obtained grains were octahedral grains having a sphere-equivalent diameter of 0.99 μm.

Emulsion 5

1 l of distilled water and 15 ml of an aqueous potassium thiocyanate solution (2 N) were added to 556 g of the seed emulsion 1. 88 g of the solution A and the solution C were added to the resultant solution mixture by a controlled double jet method over 10 minutes while the temperature of the solution mixture was maintained at 75° C. Thereafter, 88 g of the solution A and the solution D were added to the resultant solution mixture by the controlled double jet method over 10 minutes. Subsequently, 88 g the solution A and the solution E were added to the resultant solution mixture by the controlled double jet method over 10 minutes. Thereafter, 176 g of the solution A and the solution C were added to the resultant solution mixture by the controlled double jet method over 20 minutes. During addition of the solution A, the flow rate of each of the solutions C, D, and E was controlled such that the pBr of the solution mixture was 3.00.

After the addition, the prepared emulsion was washed by a flocculation method, and 50 g of inert gelatin were added to the emulsion, then the pH and the pAg were adjusted to be 5.0 and 8.6, respectively, at a temperature of 40° C. The obtained grains were octahedral grains having a sphere-equivalent diameter of 0.91 μm.

Emulsion 6

1 l of distilled water and 15 ml of an aqueous potassium thiocyanate solution (2 N) were added to 556 g of the seed emulsion 1. 88 g of the solution A and the solution C were added to the resultant solution mixture by a controlled double jet method over 10 minutes while the temperature of the solution mixture was maintained at 75° C. Thereafter, 88 g of the solution A and the solution D were added to the resultant solution mixture by the controlled double jet method over 10 minutes. Subsequently, 88 g the solution A and the solution E were added to the resultant solution mixture by the controlled double jet method over 10 minutes. Thereafter, 176 g of the solution A and the solution G were added to the resultant solution mixture by the controlled double jet method over 20 minutes. During addition of the solution A, the flow rate of each of the solutions C, D, E, and G was controlled such that the pBr of the solution mixture was 3.00.

After the addition, the prepared emulsion was washed by a normal flocculation method, and 50 g of inert gelatin were added to the emulsion, then the pH and the pAg were adjusted to be 5.0 and 8.6, respectively, at a temperature of 40° C. The obtained grains were octahedral grains having a sphere-equivalent diameter of 0.91 μm.

Emulsion 7

1 l of distilled water and 15 ml of an aqueous potassium thiocyanate solution (2 N) were added to 667 g of the seed emulsion 1. 176 g of the solution A and the solution H were added to the resultant solution mixture by a controlled double jet method over 20 minutes while the temperature of the solution mixture was maintained at 75° C. Thereafter, 176 g of the solution A and the solution B were added to the resultant solution mixture by the controlled double jet method over 20 minutes. During addition of the solution A, the flow rate of each of the solutions B and H was controlled such that the pBr of the solution mixture was 3.00.

After the addition, the prepared emulsion was washed by a normal flocculation method, and 50 g of inert gelatin were added to the emulsion, then the pH and the pAg were adjusted to be 5.0 and 8.6, respectively, at a temperature of 40° C. The obtained grains were octahedral grains having a sphere equivalent diameter of 0.87 μm.

Emulsion 8

1 l of distilled water and 15 ml of an aqueous potassium thiocyanate solution (2 N) were added to 667 g of the seed emulsion 1. 176 g of the solution A and the solution H were added to the resultant solution mixture by a controlled double jet method over 20 minutes while the temperature of the solution mixture was maintained at 75° C. Thereafter, 176 g of the solution A and the solution F were added to the resultant solution mixture by the controlled double jet method over 20 minutes. During addition of the solution A, the flow rate of each of the solutions F and H was controlled such that the pBr of the solution mixture was 3.00.

After the addition, the prepared emulsion was washed by a normal flocculation method, and 50 g of inert gelatin were added to the emulsion, then the pH and the pAg were adjusted to be 5.0 and 8.6, respectively, at a temperature of 40° C. The obtained grains were octahedral grains having a sphere-equivalent diameter of 0.87 μm.

Emulsion 9

1 l of distilled water and 15 ml of an aqueous potassium thiocyanate solution (2 N) were added to 667 g of the seed emulsion 1. 176 g of the solution A and the solution B were added to the resultant solution mixture by a controlled double jet method over 20 minutes while the temperature of the solution mixture was maintained at 75° C. Thereafter, 176 g of the solution A and the solution F were added to the resultant solution mixture by the controlled double jet method over 20 minutes. During addition of the solution A, the flow rate of each of the solutions B and F wa controlled such that the pBr of the solution mixture was 3.00.

After the addition, the prepared emulsion was washed by a normal flocculation method, and 50 g of inert gelatin were added to the emulsion, then the pH and the pAg were adjusted to be 5.0 and 8.6. respectively, at a temperature of 40° C. The obtained grains were octahedral grains having a sphere-equivalent diameter of 0.87 μm.

The structures of the emulsions 2 to 9 are shown in Table 4.

In Table 4, $I_i$, $I_m^1$, $I_m^2$, $I_m^3$, and $I_o$ represent formulation values.

TABLE 4

| Emulsion No. | Silver Iodide Content (mol %) | | | | |
|---|---|---|---|---|---|
| | $I_i$ | $I_m^1$ | $I_m^2$ | $I_m^3$ | $I_o$ |
| 2 | 0* | — | — | — | 0 |
| | (50) | | | | (50) |
| 3 | 0 | 6 | — | — | 3 |
| | (40) | (30) | | | (30) |

TABLE 4-continued

| Emulsion No. | Silver Iodide Content (mol %) | | | | |
|---|---|---|---|---|---|
| | $I_i$ | $I_m^1$ | $I_m^2$ | $I_m^3$ | $I_o$ |
| 4 | 0 | 6 | — | — | 10 |
| | (40) | (30) | | | (30) |
| 5 | 0 | 3 | 6 | 9 | 3 |
| | (50) | (10) | (10) | (10) | (20) |
| 6 | 0 | 3 | 6 | 9 | 12 |
| | (50) | (10) | (10) | (10) | (20) |
| 7 | 0 | 20 | — | — | 0 |
| | (60) | (20) | | | (20) |
| 8 | 0 | 20 | — | — | 10 |
| | (60) | (20) | | | (20) |
| 9 | 0 | — | — | — | 10 |
| | (80) | | | | (20) |

*Numerals in parenthesis indicate a molar fraction (%) in a grain, and $I_i$, $I_m$, and $I_o$ indicate silver iodide contents in a core, an intermediate shell, and an outermost shell.

Each of the emulsions 2 to 9 was subjected to gold-sulfur sensitization as follows. That is, each emulsion was heated up to 60° C, and $4\times10^{-4}$ mol/mol Ag of the following sensitizing dye Dye-1, $1\times10^{-4}$ mol/mol Ag of the antifoggant V-8 described above, $2.0\times10^{-5}$ mol/mol Ag of sodium thiosulfate, $3.0\times10^{-5}$ mol/mol Ag of chloroauric acid, and $8.0\times10^{-4}$ mol/mol Ag of potassium thiocyanate were sequentially added to the resultant emulsion and chemically sensitized for optimal period. In this case, "chemical sensitization was optimally performed" means that the highest sensitivity is obtained by 1/10-sec. exposure after the chemical sensitization.

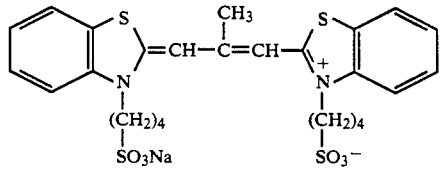

Dye-1

Each of the emulsions 2 to 9 was subjected to gold-sulfur-selenium sensitization as follows. That is, each emulsion was heated up to 70° C., $4\times10^{-4}$ mol/mol Ag of the above sensitizing dye Dye-1, $2\times10^{-4}$ mol/mol Ag of the above antifoggant V-8, $1.0\times10^{-5}$ mol/mol Ag of sodium thiosulfate, $4.0\times10^{-5}$ mol/mol Ag of chloroauric acid, $2.4\times10^{-3}$ mol/mol Ag of potassium thiocyanate, and $1.4\times10^{-5}$ mol/mol Ag of N,N-dimethyselenourea were sequentially added to the resultant emulsion and chemically sensitized for optimal periods.

Layers having the following formulations were sequentially formed on a triacetylcellulose support from the support side, thereby forming a coated sample. The emulsions chemically sensitized as described above were used as an emulsion layer 2 to form sample Nos. 1 to 18.

(Lowermost Layer)

Binder: Gelatin — 1 g/m²

Fixing Accelerator:

E-1

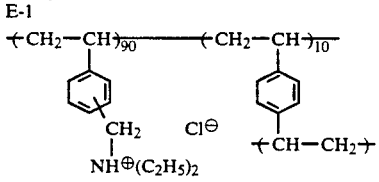

-continued

| | |
|---|---|
| (Emulsion Layer 1) | |
| Emulsion: Spherical monodisperse silver iodobromide grains having circle-equivalent diameter of 0.4 μm, variation coefficient = 13%, silver iodide content = 3 mol % | |
| Coating Silver Amount: | 1.5 g/m$^2$ |
| Binder: Gelatin | 1.6 g/Ag 1 g |
| Sensitizing Dye: 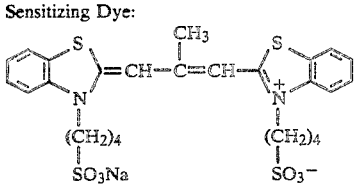 | |
| Additive: $C_{18}H_{35}O(CH_2CH_2O)_{20}H$ | 5.8 mg/Ag 1 g |
| Coating Aid: Sodium dodecylbenzenesulfonate | 0.07 mg/m$^2$ |
| Potassium poly p-styrenesulfonate | 0.7 mg/m$^2$ |
| (Emulsion layer 2) | |
| Emulsion: Various types of emulsions | |
| Coating Silver Amount: | 4.0 g/m$^2$ |
| Binder, Additive, and Coating Aid: the same as in the emulsion layer 1 | |
| (Surface Protective Layer) | |
| Binder: Gelatin | 0.7 g/m$^2$ |
| Coating Aid: Sodium N-oleoyl-N-methyltaurate | 0.2 mg/m$^2$ |
| Mat Agent: Polymethylmethacrylate fine grains (average grain size = 3 μm) | 0.13 mg/m$^2$ |

These samples were preserved at a temperature of 25° C. and a humidity of 65% RH for seven days after coating. Each sample was exposed to a tungsten light bulb (color temperature=2,854 K) through a continuous wedge for 1/10 sec., developed at 20° C. for seven min. by using a D-76 developer solution, fixed by a fixing solution (FUJI FIX: available from Fuji Photo Film Co., Ltd.), and wafer washed and dried.

The sensitivity of the obtained emulsion is represented by a relative value of a reciprocal of an exposure amount required for an optical density to be fog +0.1.

The graininess of each sample was evaluated.

After each sample was evenly exposed by a light amount for giving a density of fog +0.5 and developed as described above, an RMS granularity was measured by a method described in Macmillan Co., "The Theory of The Photographic Process", page 619.

The obtained results are summarized in Table 5.

TABLE 5

| Sample No. | Emulsion No. | Chemical Sensitization | Relative Sensitivity | Fog | Relative Granularity |
|---|---|---|---|---|---|
| 1 (Comparative Example) | 2 | Gold-Sulfur | 100 | 0.14 | 100 |
| 2 (Comparative Example) | 2 | Gold-Sulfur-Selenium | 107 | 0.19 | 100 |
| 3 Comparative Example) | 3 | Gold-Sulfur | 115 | 0.13 | 92 |
| 4 (Comparative Example) | 3 | Gold-Sulfur-Selenium | 120 | 0.20 | 93 |
| 5 (Comparative Example) | 4 | Gold-Sulfur | 132 | 0.13 | 84 |
| 6 (Presnet Invention) | 4 | Gold-Sulfur-Selenium | 162 | 0.12 | 84 |

TABLE 5-continued

| Sample No. | Emulsion No. | Chemical Sensitization | Relative Sensitivity | Fog | Relative Granularity |
|---|---|---|---|---|---|
| 7 (Comparative Example) | 5 | Gold-Sulfur | 126 | 0.13 | 90 |
| 8 (Comparative Example ) | 5 | Gold-Sulfur-Selenium | 129 | 0.18 | 92 |
| 9 (Comparative Example) | 6 | Gold-Sulfur | 129 | 0.14 | 81 |
| 10 (Presnet Invention) | 6 | Gold-Sulfur-Selenium | 166 | 0.12 | 80 |
| 11 (Comparative Example) | 7 | Gold-Sulfur | 120 | 0.14 | 90 |
| 12 (Comparative Example) | 7 | Gold-Sulfur-Selenium | 123 | 0.21 | 94 |
| 13 (Comparative Example) | 8 | Gold-Sulfur | 120 | 0.14 | 82 |
| 14 (Presnet Invention) | 8 | Gold-Sulfur-Selenium | 162 | 0.12 | 82 |
| 15 (Comparative Example) | 9 | Gold-Sulfur | 129 | 0.13 | 88 |
| 16 (Presnet Invention) | 9 | Gold-Sulfur-Selenium | 162 | 0.13 | 89 |

As is apparent from Table 5, each emulsion of the present invention has low fog, high sensitivity, and excellent granularity.

EXAMPLE-2

Preparation of Emulsion 10

1,000 ml of an aqueous solution containing 10.5 g of gelatin and 3 g of KBr were stirred at 60° C., and an aqueous $AgNO_3$ (8.2 g) solution and an aqueous KBr (containing 5.7 g of KBr and 0.35 g of KI) solution were added to the solution by a double jet method.

Gelatin was added to the resultant solution mixture, then the temperature was set to be 75° C. After a potential was adjusted to be −40 mV, an aqueous $AgNO_3$ (136.3 g) solution and an aqueous KBr (containing 4.2 mol % of KI) solution were added to the resultant solution mixture by the double jet method. At this time, the silver potential was kept at −40 mV with respect to a saturated calomel electrode.

Thereafter, an aqueous $AgNO_3$ (25.5 g) solution and an aqueous KBr (containing 10.0 mol % of KI) solution were added to the resultant solution mixture by the double jet method. At this time, the silver potential was kept at −40 mV with respect to the saturated calomel electrode.

After 20 ml of 0.1 N potassium thiocyanate were added, the resultant solution mixture was desalted by a flocculation method, and a gelatin was added, then the pH and the pAg were adjusted to be 5.5 and 8.2, respectively.

This emulsion comprised tabular grains having a circle-equivalent diameter of 1.68 μm, an average thickness of 0.13 μm, and an average aspect ratio of 12.9. A variation coefficient of circle-equivalent diameter was 42%.

Emulsion 11

1,000 ml of an aqueous solution containing 10.5 g of gelatin and 3 g of KBr were stirred at 60° C., and an aqueous $AgNO_3$ (8.2 g) solution and an aqueous KBr (containing 5.7 g of KBr and 0.35 g of KI) solution were added to the solution by a double jet method.

Gelatin was added to the resultant solution mixture to set the temperature to be 75° C. After a potential was adjusted to be 0 mV, an aqueous $AgNO_3$ (136.3 g) solution and an aqueous KBr (containing 4.2 mol % of KI) solution were added to the resultant solution mixture by the double jet method. At this time, the silver potential was kept at 0 mV with respect to a saturated calomel electrode.

Thereafter, an aqueous $AgNO_3$ (25.5 g) solution and an aqueous KBr (containing 10.0 mol % of KI) solution were added to the resultant solution mixture by the double jet method. At this time, the silver potential was kept at 0 mV with respect to the saturated calomel electrode.

After 20 ml of 0.1 N potassium thiocyanate was added, the resultant solution mixture was desalted by a flocculation method, and a gelatin was added, then the pH and the pAg were adjusted to be 5.5 and 8.2, respectively. This emulsion comprised tabular grains having a circle-equivalent diameter of 1.39 μm, an average thickness of 0.21 μm, and an average aspect ratio of 6.6. A variation coefficient of circle-equivalent diameter was 24%.

electrode. After 20 ml of 0.1 N potassium thiocyanate was added, the resultant solution mixture was desalted by a flocculation method, and a gelatin was added, then the pH and the pAg were adjusted to be 5.5 and 8.2, respectively. This emulsion comprised tabular grains having a circle-equivalent diameter of 1.42 μm, an average thickness of 0.20 μm, and an average aspect ratio of 7.1. A variation coefficient of circle-equivalent diameter was 46%.

The structures of the emulsions 10 to 12 are shown in Table 6. In Table 6, $I_i$ and $I_o$ indicate formulation values.

TABLE 6

| Emulsion No. | Silver Iodide Content (mol %) $I_1$ | $I_o$ | Average Aspect Ratio |
|---|---|---|---|
| 10 | 4.2 (85)* | 10 (15) | 12.9 |
| 11 | 4.2 (85) | 10 (15) | 6.6 |
| 12 | 17 (5) | 10 (95) | 7.1 |

*numerals in parenthesis indicate a molar ratio (%) in a grain.

The emulsions 10, 11, and 12 were subjected to gold-sulfur sensitization as follows. That is, each emulsion was heated up to 64° C., and $4.3\times10^{-4}$ mol/mol Ag of the following sensitizing dye Dye-2, $1.3\times10^{-4}$ mol/mol Ag of the following sensitizing dye Dye-3, and 1.8 $10^{-4}$ mol/mol Ag of the following sensitizing dye Dye-4:

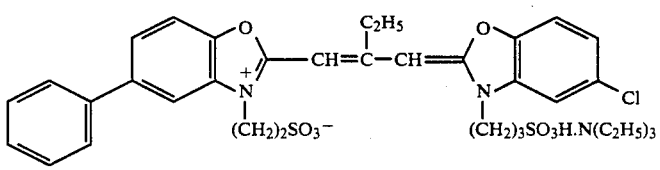

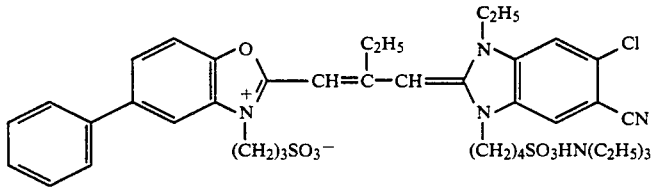

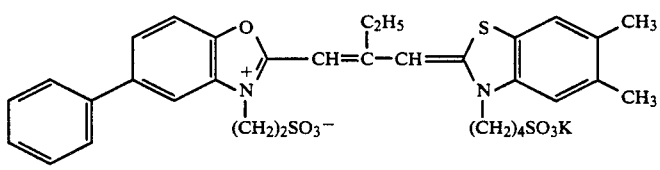

Emulsion 12

1,000 ml of an aqueous solution containing 32 g of gelatin and 2 g of KBr were stirred at 60° C., and an aqueous $AgNO_3$ (8.2 g) solution and an aqueous KBr (containing 4.9 g of KBr and 1.4 g of KI) solution were added to the solution by a double jet method. Gelatin was added to the resultant solution mixture, then the temperature was set to be 75° C. After a potential was adjusted to be 0 mV, an aqueous $AgNO_3$ (161.8 g) solution and an aqueous KBr (containing 10 mol % of KI) solution were added to the resultant solution mixture by the double jet method. At this time, the silver potential was kept at 0 mV with respect to a saturated calomel $2\times10^{-4}$ mol/mol Ag of the above antifoggant II-1, $6.2\times10^{-6}$ mol/mol Ag of sodium thiosulfate, $1.0\times10^{-5}$ mol/mol Ag of chloroauric acid, and $1.2\times10^{-3}$ mol/mol Ag of potassium thiocyanate were added to optimally perform chemical sensitization. In this case, "optimally perform chemical sensitization" means that the highest sensitivity was obtained when 1/100-sec. exposure was performed after chemical sensitization.

The emulsions 10, 11, and 12 were subjected to gold-sulfur-selenium sensitization as follows. That is, each emulsion was heated up to 64° C., and $4.3\times10^{-4}$ of the above sensitizing of Dye-2, $1.3\times10^{-4}$ of the dye Dye-3, and $1.8\times10^{-4}$ mol/mol Ag of the dye Dye-4, $6\times10^{-4}$ mol/mol Ag of the above antifoggant II-1, $6.2\times10^{-6}$ mol/mol Ag of sodium thiosulfate, $1.8\times10^{-5}$ mol/mol Ag of chloroauric acid, $2.4\times10^{-3}$ mol/mol Ag of potassium thiocyanic acid, and $8.3\times10^{-6}$ mol/mol Ag of N,N dimethylselenourea were added to optimally perform chemical sensitization.

Emulsions subjected to chemical sensitization as described above and protective layers in amounts as listed in Table 7 were coated on triacetylcellulos film supports having undercoating layers, thereby forming sample Nos. 17 to 22.

TABLE 7

| Emulsion Coating Conditions | |
|---|---|
| (1) Emulsion Layer | |
| Emulsion...Various emulsions | (silver $2.1\times10^{-2}$ mol/m$^2$) |
| Coupler | ($1.5\times10^{-3}$ mol/m$^2$) |
| 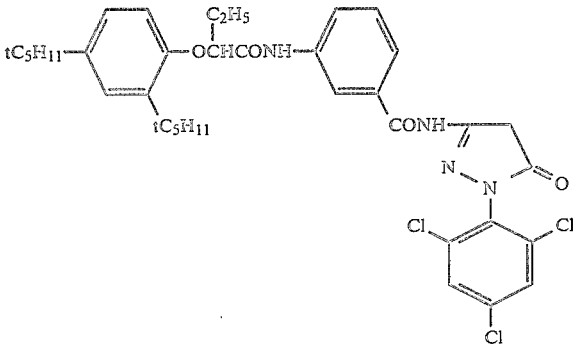 | |
| Tricresylphosphate | (1.10 g/m$^2$) |
| Gelatin | (2.30 g/m$^2$) |
| (2) Protective Layer | |
| 2,4-dichlorotriazine-6-hydroxy-s-triazine sodium salt | (0.08 g/m$^2$) |
| Gelatin | (1.80 g/m$^2$) |

These samples were left to stand at a temperature of 40° C. and a relative humidity of 70% for 14 hours and exposed for 1/100 sec. through a gelatin filter SC 50 available from Fuji Photo Film Co., Ltd. and a continuous wedge, and the following color development was performed.

The densities of the developed samples were measured by using a green filter.

| Step | Time | Temperature |
|---|---|---|
| Color Development | 2 min. 00 sec. | 40° C. |
| Bleach-Fixing | 3 min. 00 sec. | 40° C. |
| Washing (1) | 20 sec. | 35° C. |
| Washing (2) | 20 sec. | 35° C. |
| Stabilization | 20 sec. | 35° C. |
| Drying | 50 sec. | 65° C. |

The processing solution compositions will be described below.

| | (g) |
|---|---|
| (Color Developer) | |
| Diethylenetriaminepentaacetic Acid | 2.0 |
| 1-hydroxyethylidene-1,1-diphosphonic Acid | 3.0 |
| Sodium Sulfite | 4.0 |
| Potassium Carbonate | 30.0 |
| Potassium Bromide | 1.4 |
| Potassium Iodide | 1.5 mg |

-continued

| | (g) |
|---|---|
| Hydroxylamine Sulfate | 2.4 |
| 4-[N-ethyl-N-(β-hydroxyethyl)amino] 2-methylaniline Sulfate | 4.5 |
| Water to make | 1.0 l |
| pH | 10.05 |
| (Bleach-Fixing Solution) | |
| Ferric Ammonium Ethylenediaminetetraacetate (Dihydrate) | 90.0 |
| Disodium Ethylenediaminetetraacetate | 5.0 |
| Sodium Sulfite | 12.0 |
| Ammonium Thiosulfate Aqueous Solution (70%) | 260.0 ml |
| Acetic Acid (98%) | 5.0 ml |
| Bleaching Accelerator | 0.01 mol |
| 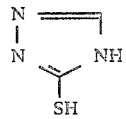 | |
| Water to make | 1.0 l |
| pH | 6.0 |
| (Washing Solution) | |
| Tap water was supplied to a mixed-bed column filled with an H type strongly acidic cation exchange resin (Amberlite IR-120B: available from Rohm & Haas Co.) and an OH type strongly basic anion exchange resin (Amberlite IR-400) to set the concentrations of calcium and magnesium to be 3 mg/l or less. Subsequently, 20 mg/l of sodium dichloro isocyanurate and 1.5 g/l of sodium sulfate were added. The pH of the solution fell within the range of 6.5 to 7.5. | |
| (Stabilizing Solution) | |
| Formalin (37%) | 2.0 ml |
| Polyoxyethylene-p-monononyl-phenylether (average polymerization degree = 10) | 0.3 |
| Disodium Ethylenediaminetetraacetate | 0.05 |
| Water to make | 1.0 |
| pH | 5.0 to 8.0 |

The sensitivity is represented by a relative value of a reciprocal of an exposure amount (lux sec.) for giving a density of fog+0.2.

In addition, the grainularity of each sample was evaluated.

After each sample was evenly exposed by a light amount for giving a density of fog+0.5 and developed as described above, an RMS granularity was measured by the method described in Macmillan Co., "The Theory of The Photographic Process", page 619.

The obtained results are summarized in Table 8.

TABLE 8

| Sample No. | Emulsion No. | Chemical Sensitization | Relative Sensitivity | Fog | Relative Granularity |
|---|---|---|---|---|---|
| 17 (Comparative Example) | 10 | Gold-Sulfur | 100 | 0.21 | 100 |
| 18 (Comparative Example) | 10 | Gold-Sulfur-Selenium | 129 | 0.38 | 106 |
| 19 (Comparative Example) | 11 | Gold-Sulfur | 109 | 0.19 | 86 |
| 20 (Presnet Invention) | 11 | Gold-Sulfur-Selenium | 224 | 0.20 | 88 |
| 21 (Comparative Example) | 12 | Gold-Sulfur | 79 | 0.24 | 78 |
| 22 (Comparative Example) | 12 | Gold-Sulfur-Selenium | 109 | 0.33 | 82 |

As is apparent from Table 8, in each emulsion of the present invention, fog was relatively low with respect to sensitivity. In addition, the grainularity of the sample was relatively excellent.

EXAMPLE-3

The emulsions 10, 11, and 12 prepared in Example-2 were subjected to gold-sulfur-selenium sensitization as follows. That is, each emulsion was heated up to 72° C., and $4.3\times10^{-4}$ mol/mol Ag of the following sensitizing dye Dye-5, $2.2\times10^{-4}$ mol/mol Ag of the following sensitizing dye Dye-6, $22\times10^{-5}$ mol/mol Ag of the following dyes Dye-7:

Dye-5

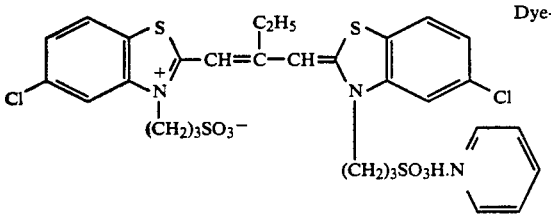

Dye-6

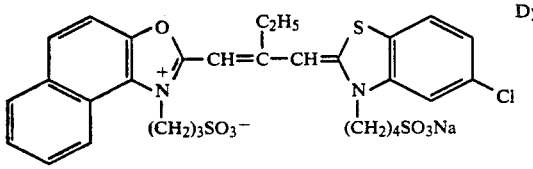

-continued

Dye-7

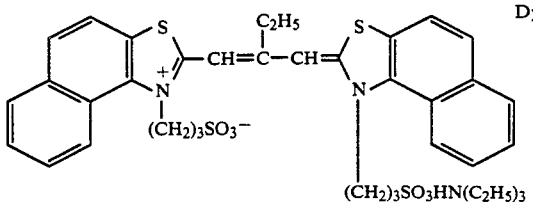

$1\times10^{-4}$ mol/mol Ag of the above antifoggant, $3.2\times10^{-6}$ mol/mol Ag of 5-benzylidene-3-ethylrohdanine, $9.2\times10^{-6}$ mol/mol Ag of chloroauric acid, $3.0\times10^{-3}$ mol/mol Ag of potassium thiocyanate, and optimally perform chemical sensitization. In this case, "optimally perform chemical sensitization" means that the highest sensitivity was obtained when 1/100-sec. exposure was performed after chemical sensitization.

Layers having the following compositions were formed on a undercoated triacetylcellulose film support, thereby forming multilayered color light-sensitive material samples 301 to 303.

Compositions of Light-Sensitive Layers

The coating amount is represented in units of g/m². The coating amounts of a silver halide and colloid silver are represented in units of g/m² of silver, and that of a sensitizing dye is represented by the number of mols per mol of the silver halide in the same layer. Symbols representing additives have the following meanings. Note that if an additive has a plurality of effects, only one of the effects is shown.

UV: ultraviolet absorbent, Solv: high-boiling organic solvent, W: coating aid, H: film hardener, ExS: sensitizing dye, ExC: cyan coupler, ExM: magenta coupler, ExY: yellow coupler, Cpd: additive

| | |
|---|---|
| Layer 1: Antihalation Layer | |
| Black Colloid Silver coating silver amount | 0.2 |
| Gelatin | 2.2 |
| UV-1 | 0.1 |
| UV-2 | 0.2 |
| Cpd-1 | 0.05 |
| Solv-1 | 0.01 |
| Solv-2 | 0.01 |
| Solv-3 | 0.08 |
| Layer 2: Interlayer | |
| Fine Silver Bromide Grain (sphere-equivalent diameter = 0.07/μm) coating silver amount | 0.15 |
| Gelatin | 1.0 |
| Cpd-2 | 0.2 |
| Layer 3: 1st Red-Sensitive Emulsion Layer | |
| Silver Iodobromide Emulsion (AgI = 10.0 mol %, internally high AgI type, sphere-equivalent diameter = 0.7 μm, variation coefficient of sphere-equivalent diameter = 14%, tetradecahedral grain) coating silver amount | 0.26 |
| Silver Iodobromide Emulsion (AgI = 4.0 mol %, internally high AgI type, sphere-equivalent diameter = 0.4 μm, variation coefficient of sphere-equivalent diameter = 22%, tetradecahedral grain) coating silver amount | 0.2 |
| Gelatin | 1.0 |
| ExS-1 | $4.5\times10^{-4}$ |
| ExS-2 | $1.5\times10^{-4}$ |
| ExS-3 | $0.4\times10^{-4}$ |
| ExS-4 | $0.3\times10^{-4}$ |
| ExC-1 | 0.33 |
| ExC-2 | 0.009 |

-continued

| | |
|---|---|
| ExC-3 | 0.023 |
| ExC-6 | 0.14 |
| Layer 4: 2nd Red-Sensitive Emulsion Layer | |
| Silver Iodobromide Emulsion (AgI = 16 mol %, internally high AgI type, sphere-equivalent diameter = 1.0 μm, variation coefficient of sphere-equivalent diameter = 25%, tabular grain, diameter/thickness ratio = 4.0) | |
| coating silver amount | 0.55 |
| Gelatin | 0.7 |
| ExS-1 | $3 \times 10^{-4}$ |
| ExS-2 | $1 \times 10^{-4}$ |
| ExS-3 | $0.3 \times 10^{-4}$ |
| ExS-4 | $0.3 \times 10^{-4}$ |
| ExC-3 | 0.05 |
| ExC-4 | 0.10 |
| ExC-6 | 0.08 |
| Layer 5: 3rd Red-Sensitive Emulsion Layer | |
| Emulsion 10, 11, or 12 | |
| coating silver amount | 0.9 |
| Gelatin | 0.6 |
| ExC-4 | 0.07 |
| ExC-5 | 0.06 |
| Solv-1 | 0.12 |
| Solv-2 | 0.12 |
| Layer 6: Interlayer | |
| Gelatin | 1.0 |
| Cpd-4 | 0.1 |
| Layer 7: 1st Green-Sensitive Emulsion Layer | |
| Silver Iodobromide Emulsion (AgI = 10.0 mol %, internally high AgI type, sphere-equivalent diameter = 0.7 μm, variation coefficient of sphere-equivalent diameter = 14%, tetradecahedral grain) | |
| coating silver amount | 0.2 |
| Silver Iodobromide Emulsion (AgI = 4.0 mol %, internally high AgI type, sphere-equivalent diameter = 0.4 μm, variation coefficient of sphere-equivalent diameter = 22%, tetradecahedral grain) | |
| coating silver amount | 0.1 |
| Gelatin | 1.2 |
| ExS-5 | $5 \times 10^{-4}$ |
| ExS-6 | $2 \times 10^{-4}$ |
| ExS-7 | $1 \times 10^{-4}$ |
| ExM-1 | 0.41 |
| ExM-2 | 0.10 |
| ExM-5 | 0.03 |
| Solv-1 | 0.2 |
| Solv-5 | 0.03 |
| Layer 8: 2nd Green-Sensitive Emulsion Layer | |
| Silver Iodobromide Emulsion (AgI = 10 mol %, internally high iodide type, sphere-equivalent diameter = 1.0 μm, variation coefficient of sphere-equivalent diameter = 25%, tabular grain, diameter/thickness ratio = 3.0) | |
| coating silver amount | 0.4 |
| Gelatin | 0.35 |
| ExS-5 | $3.5 \times 10^{-4}$ |
| ExS-6 | $1.4 \times 10^{-4}$ |
| ExS-7 | $0.7 \times 10^{-4}$ |
| ExM-1 | 0.09 |
| ExM-3 | 0.01 |
| SolV-1 | 0.15 |
| Solv-5 | 0.03 |
| Layer 9: Interlayer | |
| Gelatin | 0.5 |
| Layer 10: 3rd Green-Sensitive Emulsion Layer | |
| Silver Iodobromide emulsion (AgI = 10.0 mol %, internally high AgI type, sphere-equivalent diameter = 1.2 μm, variation coefficient of sphere-equivalent diameter = 28%, tabular grain, diameter/thickness ratio = 6.0) | |
| coating silver amount | 1.0 |
| Gelatin | 0.8 |
| ExS-5 | $2 \times 10^{-4}$ |
| ExS-6 | $0.8 \times 10^{-4}$ |
| ExS-7 | $0.8 \times 10^{-4}$ |
| ExM-3 | 0.01 |
| ExM-4 | 0.04 |

-continued

| | |
|---|---|
| ExC-4 | 0.005 |
| Solv-1 | 0.2 |
| Layer 11: Yellow Filter Layer | |
| Cpd-3 | 0.05 |
| Gelatin | 0.5 |
| Solv-1 | 0.1 |
| Layer 12: Interlayer | |
| Gelatin | 0.5 |
| Cpd-2 | 0.1 |
| Layer 13: 1st Blue-Sensitive Emulsion Layer | |
| Silver Iodobromide Emulsion (AgI = 10 mol %, internally high iodide type, sphere-equivalent diameter = 0.7 μm, variation coefficient of sphere-equivalent diameter = 14%, tetradecahedral grain) | |
| coating silver amount | 0.1 |
| Silver Iodobromide Emulsion (AgI = 4.0 mol %, internally high iodide type, sphere-equivalent diameter = 0.4 μm, variation coefficient of sphere-equivalent diameter = 22%, tetradecahedral grain) | |
| coating silver amount | 0.05 |
| Gelatin | 1.0 |
| ExS-8 | $3 \times 10^{-4}$ |
| ExY-1 | 0.53 |
| ExY-2 | 0.02 |
| Solv-1 | 0.15 |
| Layer 14: 2nd Blue-Sensitive Emulsion Layer | |
| Silver Iodobromide Emulsion (AgI = 19.0 mol %, internally high AgI type, sphere-equivalent diameter = 1.0 μm, variation coefficient of sphere-equivalent diameter = 16%, tetradecahedral grain) | |
| coating silver amount | 0.19 |
| Gelatin | 0.3 |
| ExS-8 | $2 \times 10^{-4}$ |
| ExY-1 | 0.22 |
| Solv-1 | 0.07 |
| Layer 15: Interlayer | |
| Fine Silver Iodobromide Grain (AgI = 2 mol %, homogeneous type, sphere-equivalent diameter = 0.13 μm) | |
| coating silver amount | 0.2 |
| Gelatin | 0.36 |
| Layer 16: 3rd Blue-Sensitive Emulsion Layer | |
| Silver Iodobromide Emulsion (AgI = 19.0 mol %, internally high AgI type, sphere-equivalent diameter = 1.4 μm, variation coefficient of sphere-equivalent diameter = 29%, tabulargrain, diameter/thickness ratio = 3.0) | |
| coating silver amount | 1.0 |
| Gelatin | 0.5 |
| ExS-8 | $1.5 \times 10^{-4}$ |
| ExY-1 | 0.2 |
| Solv-4 | 0.07 |
| Layer 17: 1st Protective Layer | |
| Gelatin | 1.8 |
| UV-1 | 0.1 |
| UV-2 | 0.2 |
| Solv-1 | 0.01 |
| Solv-2 | 0.01 |
| Layer 18: 2nd Protective Layer | |
| Fine Silver Bromide Grain (sphere-equivalent diameter = 0.07 μm) | |
| coating silver amount | 0.18 |
| Gelatin | 0.7 |
| Polymethylmethacrylate Grain (diameter = 1.5 μm) | 0.2 |
| W-1 | 0.02 |
| H-1 | 0.4 |
| Cpd-5 | 1.0 |

Formulas of the compounds used are listed in Table 9 to be presented later. The samples 301, 302, and 303 used the emulsions 10, 11, and 12 in the layer 5, respectively.

The above color photographic light-sensitive materials 301 to 303 were exposed and then processed by using an automatic developing machine (until an accumulated replenishing amount of a bleaching solution was increased to be three times a mother solution tank capacity).

| Processing Method | | | | |
|---|---|---|---|---|
| Process | Time | Temperature | Replenishing* Amount | Tank Volume |
| Color Development | 3 min. 15 sec. | 38° C. | 15 ml | 20 l |
| Bleaching | 6 min. 30 sec. | 38° C. | 10 ml | 40 l |
| Washing | 2 min. 10 sec. | 35° C. | 10 ml | 20 l |
| Fixing | 4 min. 20 sec. | 38° C. | 20 ml | 30 l |
| Washing (1) | 1 min. 05 sec. | 35° C. | Counter flow piping from (2) to (1) | 10 l |
| Washing (2) | 1 min. 00 sec. | 35° C. | 20 ml | 10 l |
| Stabilization | 1 min. 05 sec. | 38° C. | 10 ml | 10 l |
| Drying | 4 min. 20 sec. | 55° C. | | |

*A replenishing amount per meter of a 35-mm wide sample.

The compositions of the process solutions will be presented below.

| | Mother Solution (g) | Replenishment Solution (g) |
|---|---|---|
| Color Developer: | | |
| Diethylenetriamine-pentaacetic Acid | 1.0 | 1.1 |
| 1-hydroxyethylidene-1,1-diphosphonic Acid | 3.0 | 3.2 |
| Sodium Sulfite | 4.0 | 4.9 |
| Potassium Carbonate | 30.0 | 30.0 |
| Potassium Bromide | 1.4 | — |
| Potassium Iodide | 1.5 mg | — |
| Hydroxylamine Sulfate | 2.4 | 3.6 |
| 4-(N-ethyl-N-β-hydroxylethylamino)-2-methylalinine Sulfate | 4.5 | 7.2 |
| Water to make | 1.0 l | 1.0 l |
| pH | 10.05 | 10.10 |
| Bleaching Solution: | | |
| Ferric Sodium Ethylenediamine-tetraacetate Trihydrate | 100.0 | 140.0 |
| Disodium Ethylene-diaminetetraacetate | 10.0 | 11.0 |
| Ammonium Bromide | 140.0 | 180.0 |
| Ammonia Water (27%) | 6.5 ml | 2.5 ml |
| Water to make | 1.0 | 1.0 |
| pH | 6.0 | 5.5 |
| Fixing Solution: | | |
| Disodium Ethylene-diaminetetraacetate | 0.5 | 1.0 |
| Sodium Sulfite | 7.0 | 12.0 |
| Sodium Bisulfite | 5.0 | 9.5 |
| Ammonium Thiosulfate Aqueous Solution (70%) | 170.0 ml | 240.0 ml |
| Water to make | 1.0 | 1.0 |
| pH | 6.7 | 6.6 |
| Wash Solution: Common for mother and replenishment solutions Tap water was supplied to a mixed-bed column filled with an H type strongly acidic cation exchange regin (Amberlite IR-120B: available from Rohm & Haas Co.) and an OH type anion exchange resin (Amberlite IR-400) to set calcium and magnesium ion concentrations to be 3 mg/l or less. Subsequently, 20 mg/l of sodium dichloroisocyanurate and 1.5 g/l of sodium sulfate were added. The pH of the solution fell within the range of 6.5 to 7.5. | | |
| Stabilizing Solution: | | |
| Formalin (37%) | 2.0 ml | 3.0 ml |
| Polyoxyethylene-p-mononnylphenylether (average polymerization degree = 10) | 0.3 | 0.45 |
| Disodium Ethylene-diaminetetraacetate | 0.05 | 0.08 |
| Water to make | 1.0 l | 1.0 l |
| pH | 5.0–8.0 | 5.0–8.0 |

The sensitivity is represented by a fogging density, and a relative value of a reciprocal of an exposure amount for giving a density higher than the fogging density by 1.0, using a characteristic curve of a cyan image.

The results are summarized in Table 10.

TABLE 10

| Sample No. | Emulsion No. | Chemical Sensitization | Relative Sensitivity | Fog |
|---|---|---|---|---|
| 301 (Comparative Example) | 10 | Gold-Sulfur-Selenium | 100 | 0.19 |
| 302 (Present Invention) | 11 | Gold-Sulfur-Selenium | 162 | 0.14 |
| 303 (Comparative Example) | 12 | Gold-Sulfur-Selenium | 91 | 0.17 |

As is apparent from Table 10, an emulsion of the present invention has low fog and high sensitivity.

EXAMPLE-4

A reversal multilayered color light-sensitive material 210 was formed by forming layers having the following compositions on an undercoated triacetylcellulose film support.

| | |
|---|---|
| Layer 1: Antihalation Layer: | |
| Black Colloidal Silver | 0.25 g/m² |
| Ultraviolet Absorbent U-1 | 0.1 g/m² |
| Ultraviolet Absorbent U-2 | 0.1 g/m² |
| High Boiling Organic Solvent | |
| Oil-1 | 0.1 g/m² |
| Gelatin | 1.9 g/m² |
| Layer 2: Interlayer 1: | |
| Cpd D | 10 mg/m² |
| High Boiling Organic Solvent | |
| Oil-3 | 40 mg/m² |
| Gelatin | 0.4 g/m² |
| Layer 3: Interlayer 2: | |
| Surface-Fogged Fine Grain Silver Iodobromide Emulsion (average grain size = 0.06/μm, AgI content = 1 mol) | silver 0.05 g/m² |
| Gelatin | 0.4 g/m² |
| Layer 4: 1st Red-Sensitive Emulsion Layer: | |
| Silver Iodobromide Emulsion (a 1:1 mixture of a monodisperse cubic emulsion having an average grain size of 0.4 μm and an AgI content of 5 mol% and a monodisperse cubic emulsion having an average grain size of 0.2 μm and an AgI content of 5 mol%) Spectrally Sensitized with Sensitizing Dyes S-1 and S-2 | silver 0.4 g/m² |
| Coupler C-1 | 0.25 g/m² |
| High Boiling Organic Solvent | |
| Oil-2 | 0.07 cc/m² |
| Gelatin | 0.8 g/m² |
| Layer 5: 2nd Red-Sensitive Emulsion Layer: | |
| Silver Iodobromide Emulsion (a monodisperse cubic emulsion having an average grain size of 0.6 μm and an AgI content of 4 mol %) Spectrally Sensitized with Sensitizing Dyes | silver 0.4 g/m² |

-continued

| | |
|---|---|
| S-1 and S-2 | |
| Coupler C-1 | 0.5 g/m$^2$ |
| High Boiling Organic Solvent | |
| Oil-2 | 0.14 cc/m$^2$ |
| Gelatin | 0.8 g/m$^2$ |
| Layer 6: 3rd Red-Sensitive Emulsion Layer: | |
| Silver Iodobromide Emulsion Used in Sample 20 Except That Sensitizing Dyes Were Changed to Sensitizing Dyes S-1 and S-2 | silver 0.4 g/m$^2$ |
| Coupler C-1 | 1.0 g/m$^2$ |
| High Boiling Organic Solvent Oil-2 | 0.28 cc |
| Gelatin | 1.1 g/m$^2$ |
| Layer 7: Interlayer 3: | |
| Dye D-1 | 0.02 g/m$^2$ |
| Gelatin | 0.6 g/m$^2$ |
| Layer 8: Interlayer 4: | |
| Surface-Fogged Fine Grain Silver Iodobromide Emulsion (average grain size = 0.06 μm, AgI content = 1 mol %) | silver 0.05 g/m$^2$ |
| Compound Cpd A | 0.2 g/m$^2$ |
| Gelatin | 1.0 g/m$^2$ |
| Layer 9: 1st Green-Sensitive Emulsion Layer: | |
| Silver Iodobromide Emulsion (a 1:1 mixture of a monodisperse cubic emulsion having an average grain size of 0.4 μm and an AgI content of 5 mol % and a monodisperse cubic emulsion having an average grain size of 0.2 μm and an AgI content of 5 mol %) Spectrally Sensitized with Sensitizing Dyes S-3 and S-4 | silver 0.5 g/m$^2$ |
| Coupler M-1 | 0.3 g/m$^2$ |
| Compound Cpd B | 0.03 g/m$^2$ |
| Gelatin | 0.5 g/m$^2$ |
| Layer 10: 2nd Green-Sensitive Emulsion Layer: | |
| Silver Iodobromide Emulsion (monodisperse cubic emulsion having an average grain size of 0.6 μm and an AgI content of 5 mol %) Containing Sensitizing Dyes S-3 and S-4 | silver 0.4 g/m$^2$ |
| Coupler M-1 | 0.3 g/m$^2$ |
| Compound Cpd B | 0.03 g/m$^2$ |
| Gelatin | 0.6 g/m$^2$ |
| Layer 11: 3rd Green-Sensitive Emulsion Layer: | |
| Silver Iodobromide Emulsion Used in Sample 20 Except That Sensitizing Dyes Were Changed to Sensitizing Dyes S-3 and S-4 | silver 0.5 g/m$^2$ |
| Coupler M-1 | 0.8 g/m$^2$ |
| Compound Cpd B | 0.08 g/m$^2$ |
| Gelatin | 1.0 g/m$^2$ |
| Layer 12: Interlayer 5 | |
| Dye D-2 | 0.05 g/m$^2$ |
| Gelatin | 0.6 g/m$^2$ |
| Layer 13: Yellow Filter Layer: | |
| Yellow Colloidal Silver | 0.1 g/m$^2$ |
| Compound Cpd A | 0.01 g/m$^2$ |

-continued

| | |
|---|---|
| Gelatin | 1.1 g/m$^2$ |
| Layer 14: 1st Blue-Sensitive Emulsion Layer: | |
| Silver Iodobromide Emulsion (a 1:1 mixture of a monodisperse cubic emulsion having an average grain size of 0.4 μm and an AgI content of 3 mol % and an monodisperse cubic emulsion having an average grain size of 0.2 μm and an AgI content of 3 mol %) Containing Sensitizing Dyes S-5 and S-6 | silver 0.6 g/m$^2$ |
| Coupler Y-1 | 0.6 g/m$^2$ |
| Gelatin | 0.8 g/m$^2$ |
| Layer 15: 2nd Blue-Sensitive Emulsion Layer: | |
| Silver Iodobromide Emulsion (tabular emulsion having an average grain size of 0.7 μm, an aspect ratio of 7, and an AgI content of 2 mol %) Containing Sensitizing Dyes S-5 and S-6 | silver 0.4 g/m$^2$ |
| Coupler Y-1 | 0.3 g/m$^2$ |
| Coupler Y-2 | 0.3 g/m$^2$ |
| Gelatin | 0.9 g/m$^2$ |
| Layer 16: 3rd Blue-Sensitive Emulsion Layer: | |
| Silver Iodobromide Emulsion Used in Sample 20 Except That Sensitizing Dyes Were Changed to Sensitizing Dyes S-5 and S-6 | silver 0.4 g/m$^2$ |
| Coupler Y-2 | 0.7 g/m$^2$ |
| Gelatin | 1.2 g/m$^2$ |
| Layer 17: 1st Protective Layer: | |
| Ultraviolet Absorbent U-1 | 0.04 g/m$^2$ |
| Ultraviolet Absorbent U-3 | 0.03 g/m$^2$ |
| Ultraviolet Absorbent U-4 | 0.03 g/m$^2$ |
| Ultraviolet Absorbent U-5 | 0.05 g/m$^2$ |
| Ultraviolet Absorbent U-6 | 0.05 g/m$^2$ |
| Compound Cpd C | 0.8 g/m$^2$ |
| D-3 | 0.05 g/m$^2$ |
| Gelatin | 0.7 g/m$^2$ |
| Layer 18: 2nd Protective Layer: | |
| Surface-Fogged Fine Grain Silver Iodobromide Emulsion (average grain size = 0.06 μm, AgI content = 1 mol %) | silver 0.1 g/m$^2$ |
| Polymethyl Methacrylate Grains (average grain size = 1.5 μm) | 0.1 g/m$^2$ |
| 4:6 Copolymer of Methyl Methacrylate and Acrylic Acid (average grain size = 1.5 μm) | 0.1 g/m$^2$ |
| Silicone Oil | 0.03 g/m$^2$ |
| Fluorine-Containing Surfactant W-1 | 3 mg/m$^2$ |
| Gelatin | 0.8 g/m$^2$ |

Gelatin hardener H-1 and a surfactant were added to the layers in addition to the above compositions.

Formulas used to form the samples are listed in Table 11 to be presented later.

When the light-sensitive material 210 was subjected to the reversal color development following the same procedures as in Example 2, a good color reversal image could be obtained.

TABLE 9

UV-1

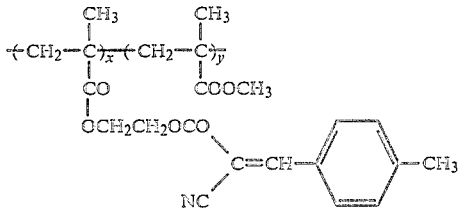

x/y = 7/3 (weight ratio)

UV-2

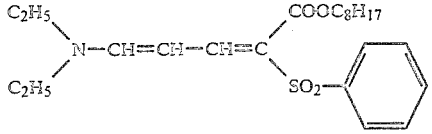

TABLE 9-continued
ExM-3
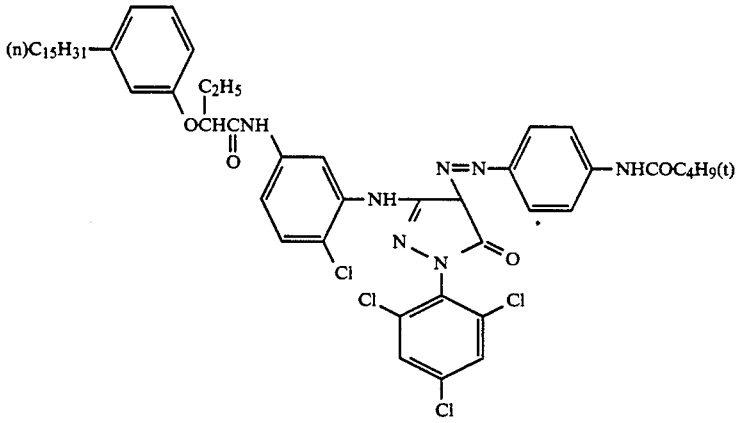
ExC-1
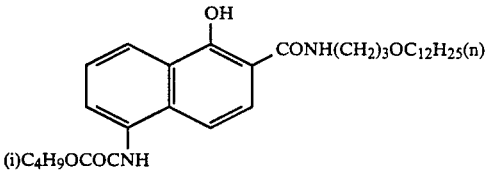
ExC-2
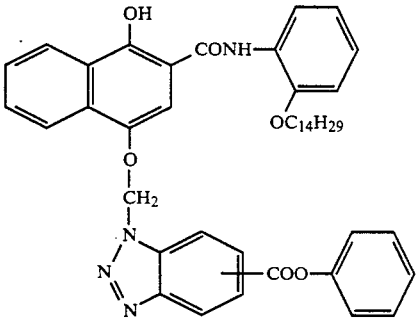
ExC-3
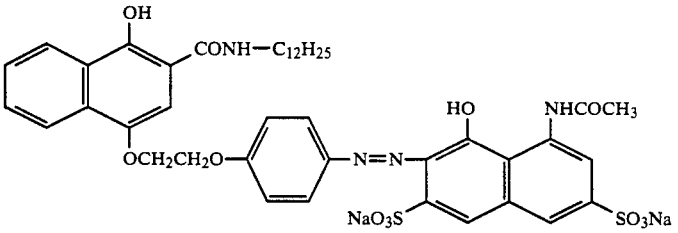
ExC-6
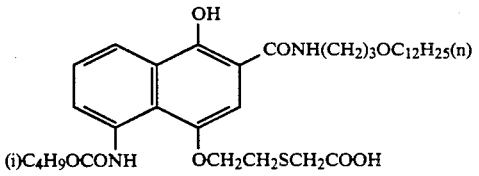
ExC-4
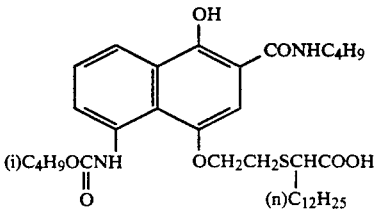

TABLE 9-continued
ExC-5
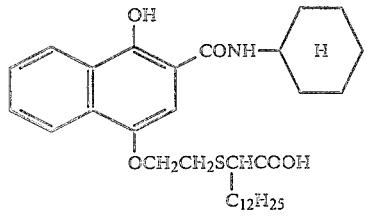
ExM-1
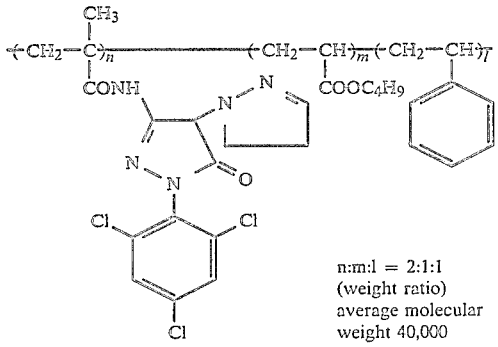
ExM-2
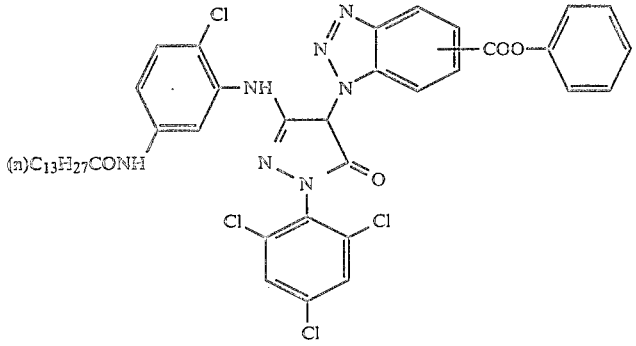
ExM-4
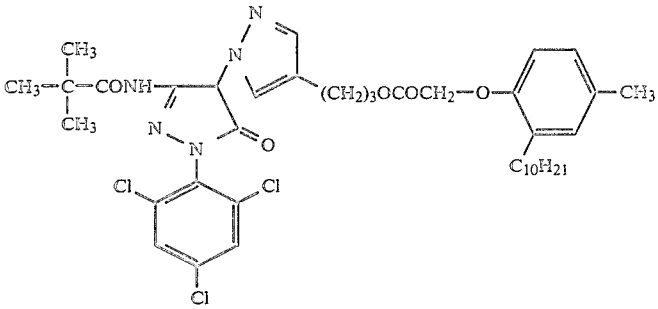
ExM-5
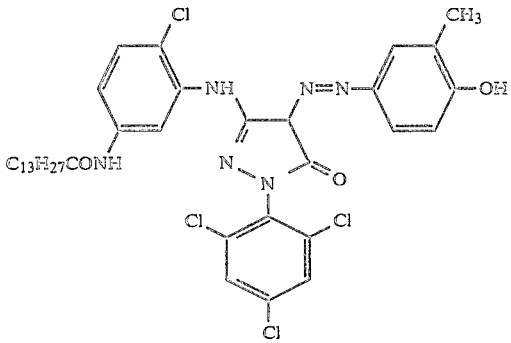

TABLE 9-continued
ExY-1
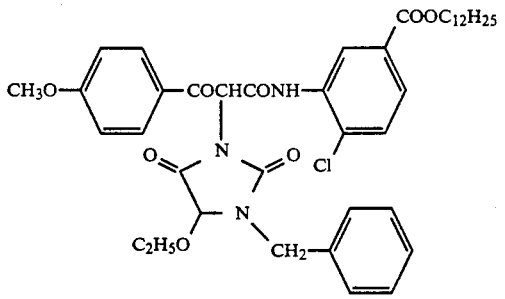
ExY-2
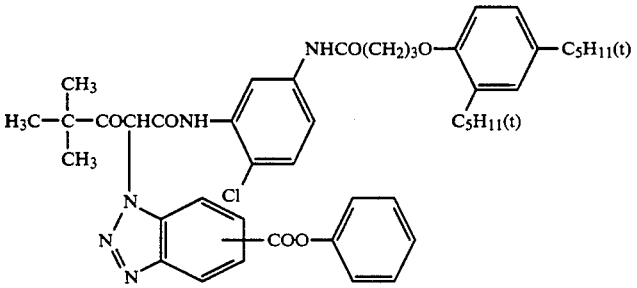
ExS-1
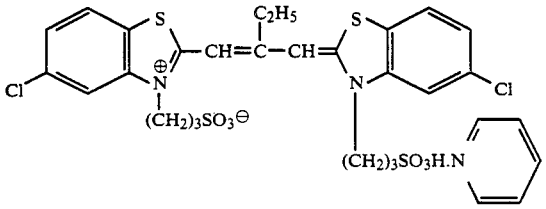
ExS-2
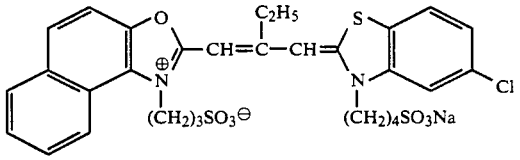
ExS-3
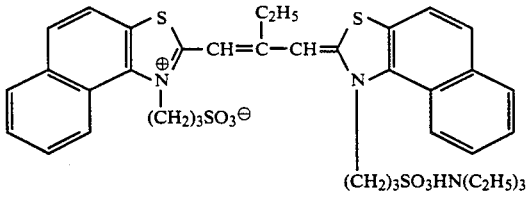
ExS-4
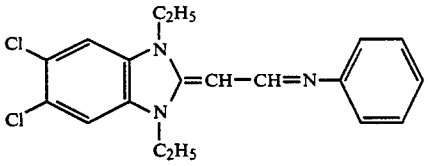
ExS-5
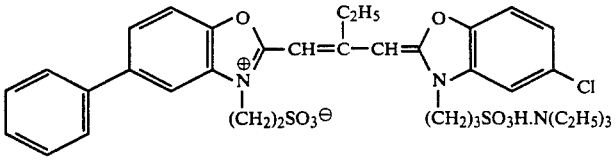

TABLE 9-continued
ExS-6
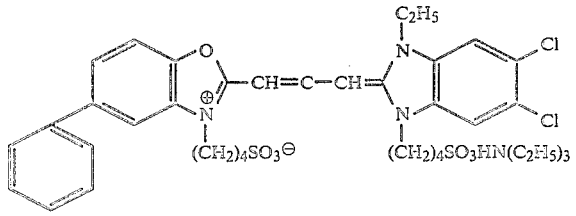
ExS-8
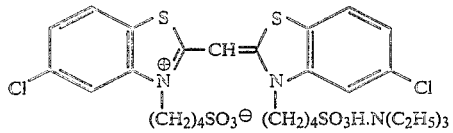
ExS-7
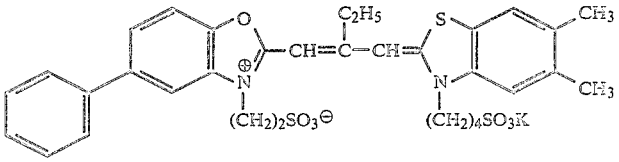
Solv-1
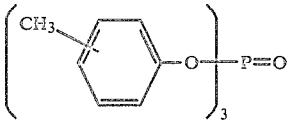
Solv-2
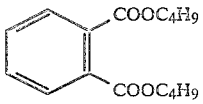
Solv-3
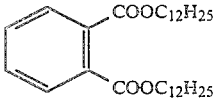
Solv-4
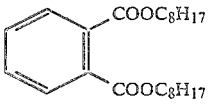
Solv-5
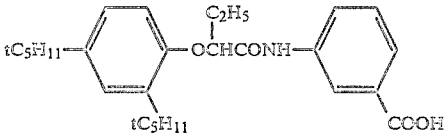
Cpd-1
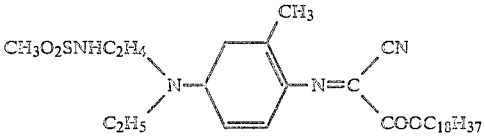
Cpd-2
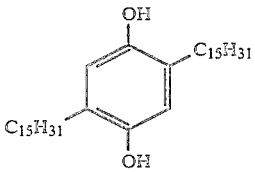

TABLE 9-continued
| | |
|---|---|
| 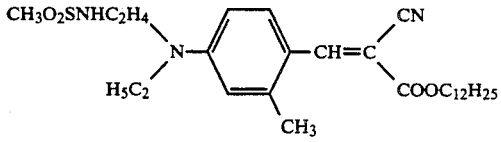 | Cpd-3 |
| 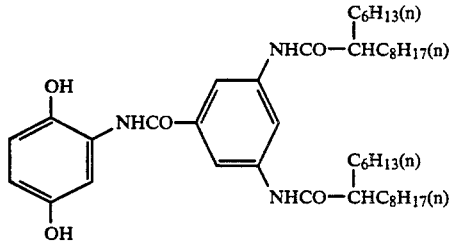 | Cpd-4 |
| 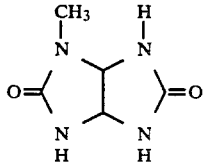 | Cpd-5 |
| $C_8F_{17}SO_2NHCH_2CH_2CH_2OCH_2CH_2N^{\oplus}(CH_3)_3$ 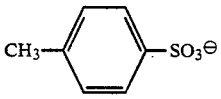 | W-1 |
| $CH_2{=}CHSO_2CH_2CONH{-}CH_2$<br>$CH_2{=}CHSO_2CH_2CONH{-}CH_2$ | H-1 |
TABLE 11
| | | | |
|---|---|---|---|
| 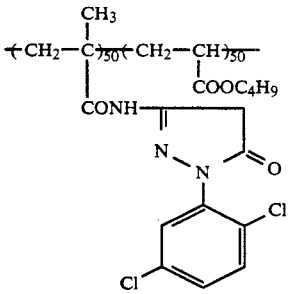 | M-1 | 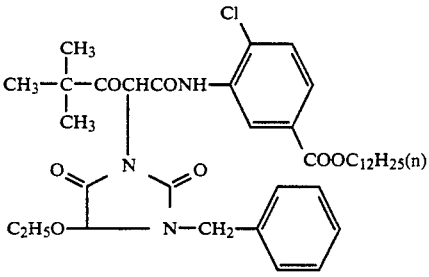 | Y-1 |
| 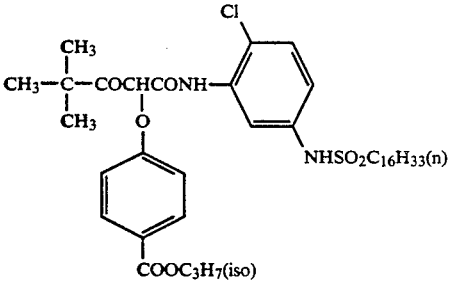 | Y-2 | dibutyl phtalate | Oil 1 |
| tricresyl phosphate | Oil 2 | 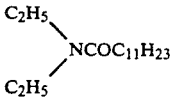 | Oil-3 |

TABLE 11-continued
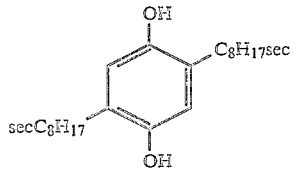
Cpd A
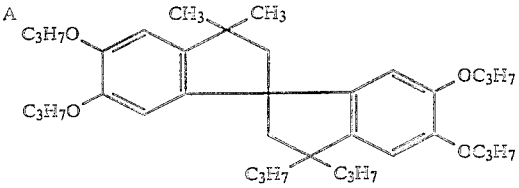
Cpd B
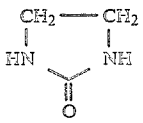
Cpd C
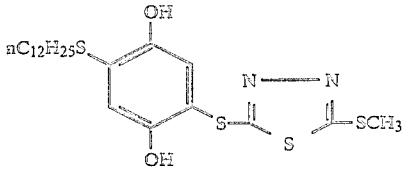
Cpd D
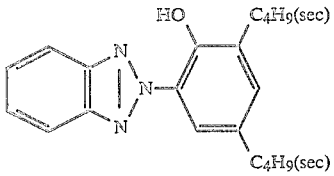
U-1
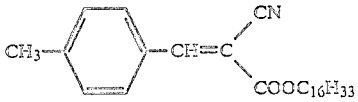
U-2
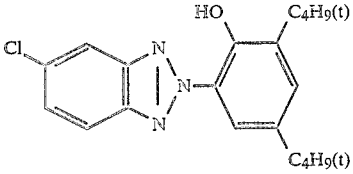
U-3
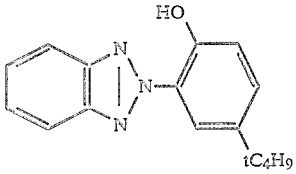
U-4
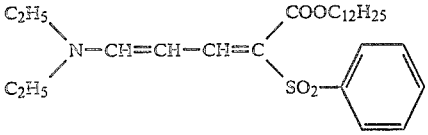
U-5
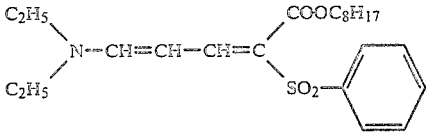
U-6
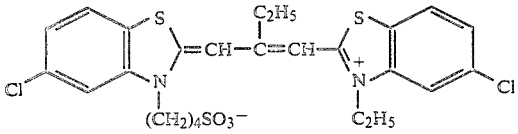
S-1
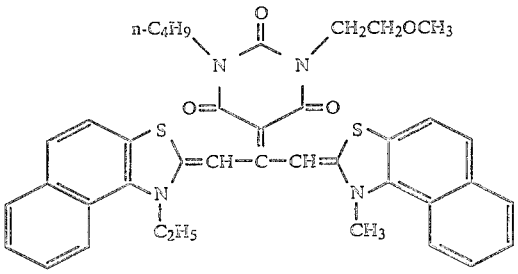
S-2
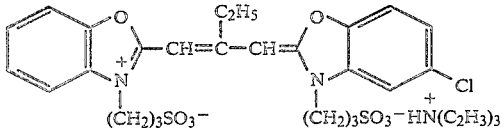
S-3
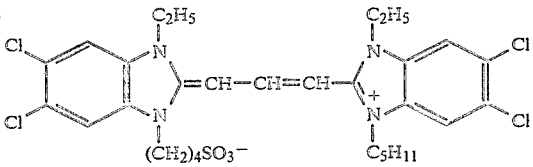
S-4
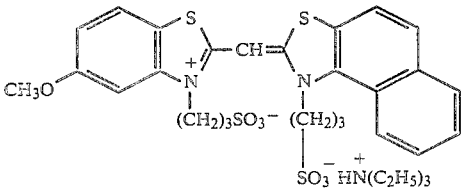
S-5
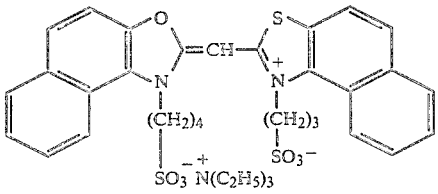
S-6

TABLE 11-continued

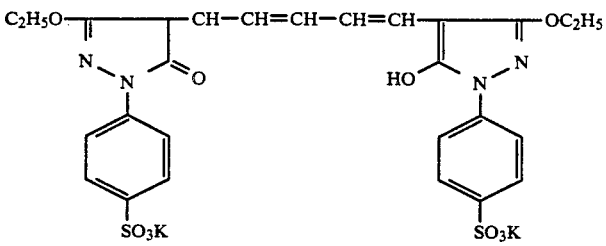

D-1

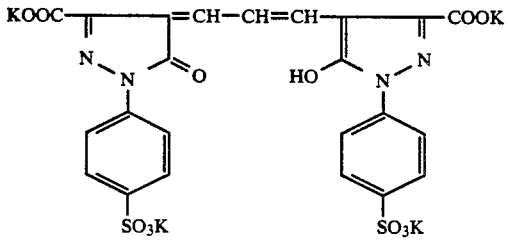

D-2

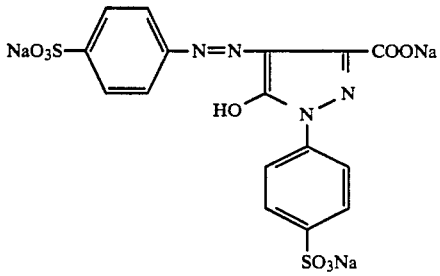

D-3

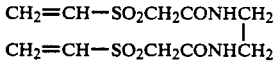

H-1

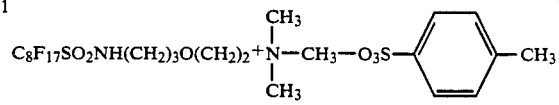

W-1

What is claimed is:

1. A silver halide photographic emulsion containing silver halide grains comprising at least a core and an outermost shell with different silver halide compositions and having an average aspect ratio of less than 8, wherein said core comprises silver iodobromide, silver chloroiodobromide, silver chlorobromide, or silver bromide, an average silver iodide content of said outermost shell is higher than that of said core and is 6 mol % or more, and said silver halide grains are subjected to all of selenium sensitization, gold sensitization, and sulfur sensitization, wherein said emulsion is capable of being chemically developed with a liquid developer solution after light imaging exposure.

2. The silver halide photographic emulsion according to claim 1, wherein said grains further comprise at least one intermediate shell between said core and said outermost shell.

3. The silver halide photographic emulsion according to claim 1, wherein a projected area of said silver halide grains occupies at least 50% of a total projected area of all the rains contained in said emulsion.

4. The silver halide photographic emulsion according to claim 1, wherein said emulsion is of a negative type.

5. The silver halide photographic emulsion according to claim 4, wherein a sensitizing dye has been added during chemical ripening or before chemical ripening.

6. The silver halide photographic emulsion according to claim 5, wherein the emulsion contains a nitrogen-containing heterocyclic compound having a mercapto group.

7. The silver halide photographic emulsion according to claim 1, wherein the amount of gold sensitizer added is $1\times10^{-7}$ to $5\times10^{-5}$ mol per mol of silver halide.

8. The silver halide photographic emulsion according to claim 2, wherein the core and the intermediate shell are in a molar ratio of 1:0.1 to 1:10 with respect to the outermost shell.

9. The silver halide photographic emulsion according to claim 1, wherein the distribution of silver iodide within the grains is uniform among the grains.

10. The silver halide photographic emulsion according to claim 1, wherein the grains are tabular grains having an aspect ratio of 3 to 8.

11. The silver halide photographic emulsion according to claim 1, wherein an unstable selenium compound and/or a stable selenium compound is added during selenium sensitization.

12. The silver halide photographic emulsion according to claim 1, wherein at least $1\times10^{-8}$ mol of selenium sensitizer per mol of silver halide is added.

13. The silver halide photographic emulsion according to claim 1, wherein the amount of sulfur sensitizer added is $1\times10^{-7}$ to $5\times10^{-5}$ mol per mol of silver halide.

14. The silver halide photographic emulsion according to claim 7, wherein the silver iodide content of the outermost shell is 6 to 40 mol %.

15. A color or black and white photographic light sensitive material, which comprises a support and a silver halide photographic emulsion containing silver halide grains comprising at least a core and an outermost shell with different silver halide compositions and having an average aspect ratio of less than 8, wherein said core comprises silver iodobromide, silver chloroiodobromide, silver chlorobromide, or silver bromide, an average silver iodide content of said outermost shell is higher than that of said core and is 6 mol % or more, and said silver halide grains are subjected to all of selenium sensitization, gold sensitization, and sulfur sensitization, wherein said photographic light sensitive material is capable of being chemically developed with a liquid developer solution after light imaging exposure.

16. A color photographic light sensitive material according to claim 15.

17. A black and white photographic light sensitive material according to claim 15.

18. A reversal color photographic light sensitive material according to claim 15.

19. A photographic light sensitive material which comprises a support and a silver halide photographic emulsion which consists essentially of (i) silver halide grains comprising a least a core and an outermost shell with different silver halide compositions and having an average aspect ratio of less than 8, wherein said core comprises silver iodobromide, silver chloroiodobromide, silver chlorobromide, or silver bromide, an average silver iodide content of said outermost shell is higher than that of said core and is 6 mol % or more, and said silver halide grains are subjected to all of selenium sensitization, gold sensitization, and sulfur sensitization, and (ii) a coupler, wherein said photographic light sensitive material is capable of being chemically developed with a liquid developer solution after light imaging exposure.

20. The silver halide photographic emulsion according to claim 15, wherein said emulsion is of a negative type.

* * * * *